US007918178B2

(12) United States Patent
Imel et al.

(10) Patent No.: US 7,918,178 B2
(45) Date of Patent: Apr. 5, 2011

(54) MODULAR FLOATING WATERCRAFT PORT ASSEMBLY

(75) Inventors: Dustin Imel, Rocky Comfort, MO (US); Curtis Downs, Denver, NC (US)

(73) Assignee: E-Z-Dock, Inc., Monett, MO (US)

( * ) Notice: Subject to any disclaimer, the term of this patent is extended or adjusted under 35 U.S.C. 154(b) by 131 days.

(21) Appl. No.: 12/125,539

(22) Filed: May 22, 2008

(65) Prior Publication Data

US 2009/0044740 A1 Feb. 19, 2009

Related U.S. Application Data

(60) Provisional application No. 60/956,215, filed on Aug. 16, 2007.

(51) Int. Cl.
*B63B 35/44* (2006.01)
*E02B 3/00* (2006.01)

(52) U.S. Cl. ..... 114/263

(58) Field of Classification Search ..... 114/258–264, 114/44–46, 49, 266, 267
See application file for complete search history.

(56) References Cited

U.S. PATENT DOCUMENTS

| | | | | |
|---|---|---|---|---|
| 5,941,660 | A | 8/1999 | Rueckert | |
| 6,006,687 | A | 12/1999 | Hillman et al. | |
| 7,069,872 | B2 | 7/2006 | Ostreng et al. | |
| 7,293,522 | B1 * | 11/2007 | Elson | 114/263 |
| 7,481,175 | B2 * | 1/2009 | Dickman | 114/263 |
| 2007/0169678 | A1 * | 7/2007 | Dickman | 114/263 |

OTHER PUBLICATIONS

International Preliminary Report on Patentability corresponding to International Appln. No. PCT/US2008/073149.

* cited by examiner

*Primary Examiner* — Daniel V Venne
(74) *Attorney, Agent, or Firm* — Polster, Lieder, Woodruff & Lucchesi, L.C.

(57) ABSTRACT

A floating watercraft port system is provided which allows for a designer to develop a port assembly of a desired configuration. The system comprises an entry member, an extension member and a bulkhead. The entry member comprises a cradle having an entrance section; and the extension member has a cradle which extends the full length of the extension member and is open at opposite ends of the extension member. Bulkheads are positioned on the entry and/or extension members at desired positions to delineate the forward ends of watercraft receiving cradles.

31 Claims, 22 Drawing Sheets

A - A

MODULAR FLOATING WATERCRAFT PORT ASSEMBLY

CROSS-REFERENCE TO RELATED APPLICATIONS

This application claims priority to U.S. Provisional App. No. 60/956,215 filed Aug. 16, 2007 which is titled Modular Floating Watercraft Assembly. This application is also related to application Ser. No. 12/125,206 filed May 22, 2008. Both of these applications are incorporated herein by reference.

STATEMENT REGARDING FEDERALLY SPONSORED RESEARCH OR DEVELOPMENT

Not Applicable.

BACKGROUND OF THE INVENTION

This invention relates to floating docks or ports for personal and small water craft, and, in particular to a modular port system for personal water craft.

There are several manufacturers of floating watercraft ports and lifts. However, the ability to customize the port/lift area of a marina is limited due to the design of most currently available watercraft ports/lifts. The owners of marinas or docks which include ports seek more and more versatility from the dock manufacturers to enable the marinas or docks to be assembled easily in different configurations. It would therefore be desirable to have an watercraft port/lift module which allows for greater customization in the design of the port/lift area of a marina.

SUMMARY OF THE DISCLOSURE

Briefly stated, a floating watercraft port system is provided which allows for a designer to develop a port assembly of a desired configuration. The system comprises an entry member, an extension member and a bulkhead (or bow stop).

The entry member comprises a front end, a back end, sides, a bottom surface, and an upper surface. The entry member defines a cradle with an entrance section in the entry member upper surface. An entrance roller is positioned at the back of the entrance section. The entrance member is designed such that the roller mounted at the back of the entrance section is at or below water level when the port is floated in water (and when no watercraft is received on the member). The entrance member additionally can be provided with a marking surface. In an illustrative embodiment, the marking surface is at the back end of the entrance member, and slopes downwardly and rearwardly such that the marking surface is visible when the port is viewed in side and end elevation. The marking surfaces can be provided with identifying indicia or visibility enhancers. The visibility enhances can, for example, be light reflective elements or light emitting elements.

The extension member comprises a front end, a back end, sides, a bottom surface, and an upper surface. An extension cradle is formed in the extension member upper surface. The extension member cradle extends the full length of the extension member and is open at the front and back ends of the extension member.

The entry and extension members can be connected in series or in parallel. Further, any desired number of entry and extension members can be utilized in a single port system. Hence, a port system can comprise a single entry member; one entry member and one extension member joined in tandem; two entry members joined head-to-head; pairs of entry and extension members joined in tandem, the pairs being joined in parallel, etc.

The bulkhead or bow stop is selectively positionable on the entry and extension members. The bow stop can be a full bow stop or a small bow stop. The full bow stop is sized to extend substantially the width of the port member. It includes an upper surface, a front surface, a back surface, side surfaces and a bottom surface. The bottom surface is shaped substantially complementarily to the port upper surface such that the bow stop rests on the port member upper surface. The back surface of the bow stop defines a bow receiving area comprised of a pair of outwardly and downwardly sloping walls connected by a downwardly sloping generally U-shaped portion, such that the bow receiving area approximates the shape of a bow of a personal watercraft.

The small bow stop is designed to be easily removed from the port members. To facilitate this, the small bow stop is provided with posts extending from its bottom surface, and the port member includes post holes which receive the bow stop posts. The small bow stop includes a handle to which a tether can be secured, such that the small bow stop can be tethered to the port.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
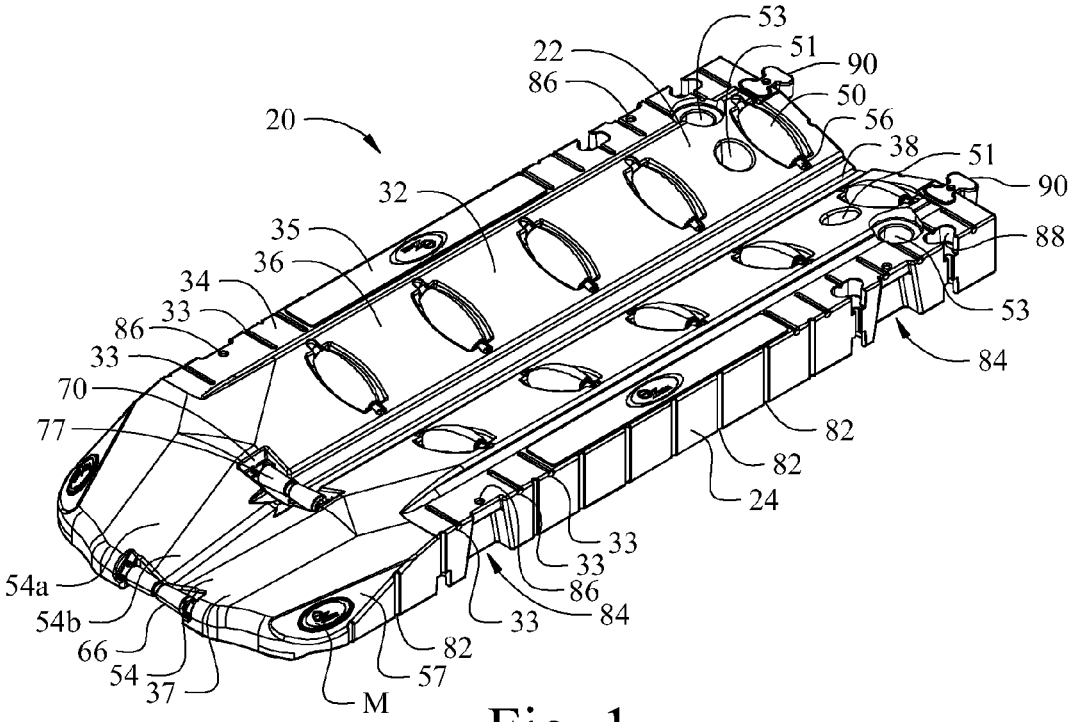
FIG. 1 is a perspective view of a port entry member with rollers and connecting elements.

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Figure 27A:
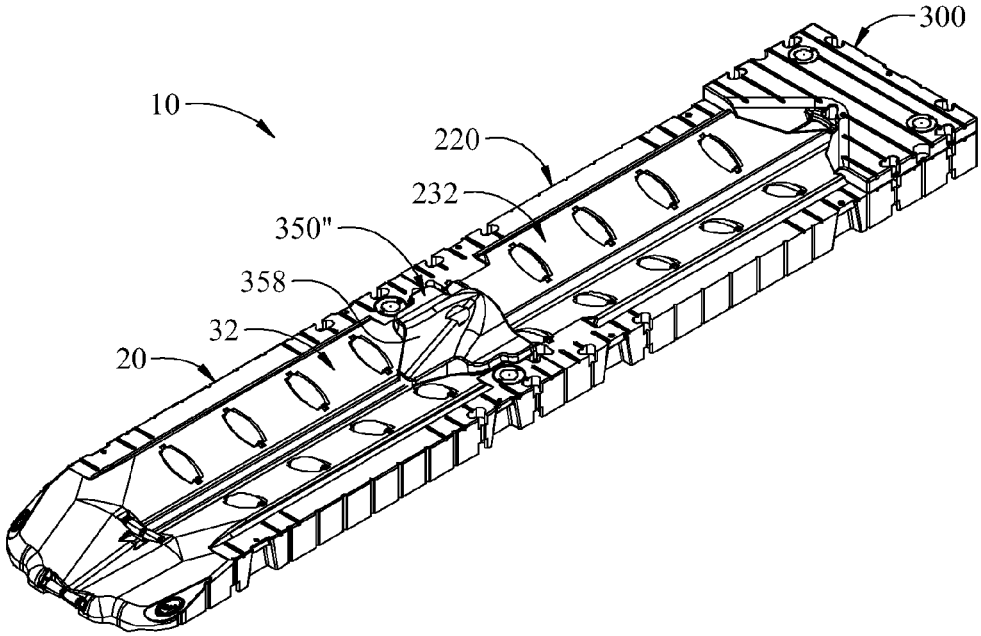
FIGS. 27A and 27B are perspective and side elevational views, respectively of an entry member and extension member connected together in tandem and provided with a small bow stop at the front of the entry member and a full bow stop at the front of the extension member.

An illustrative configuration of a personal watercraft port system 10 (FIG. 27A) comprises a port entry member 20, an extension member 220, a full bow stop 300 and a small bow stop 350, 350', 350". The small bow stop shown in FIG. 27A is the bow stop 350". The port members 20, 220 and bow stops 300, 350, 350', 350" can all be molded from plastic and are hollow. Hence, they will float. As will be described below, the port members 20, 220 can accept any of the bow stops. Further, the port members can be connected together in a myriad of configurations as seen in FIGS. 28A-F and can be incorporated into dock assemblies, examples of which are discussed below and shown in FIGS. 29A-D. Although the watercraft port system 10 is described for use with personal watercraft (PWC's), the port system 10 can also be used with other watercraft, including small boats.

The port entry member 20 is shown generally in FIGS. 1-8. The port entry member 20 includes an upper surface 22, side walls 24, a front end wall 26, a back end 28, and a bottom surface 30. The port entry member 20 is molded to provide a higher freeboard so that a PWC parked on the port member will be out of the water. Although, the port member 20 has a higher freeboard, the overall height of the port member (i.e., the height of the side walls) is substantially the same as the height of the dock members to which the port member can be connected (see FIGS. 29A-D).

Figure 4:
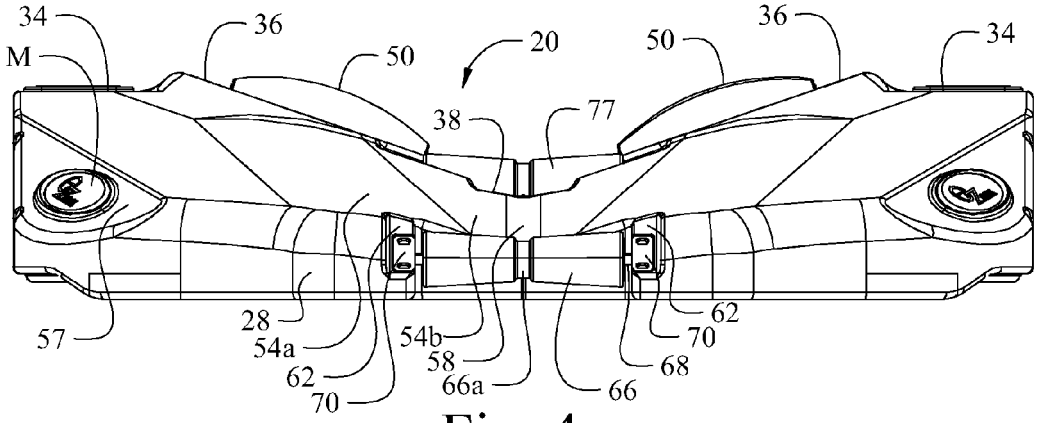
FIG. 4 is a back elevational view of the port entry member.
Figure 6:
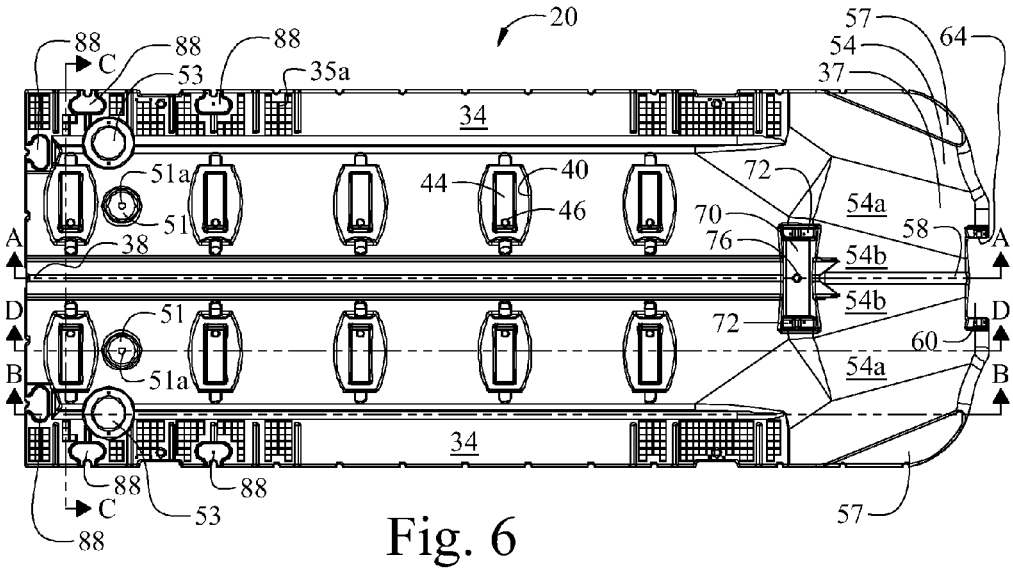
FIG. 6 is a top plan view of the port entry member without rollers.

The upper surface 22 defines a cradle 32, upper deck surfaces 34, and a sloping entrance or ramp section 37 at the back of the port entry. As seen in FIG. 4, for example, the upper deck surfaces 34 are recessed slightly below the outer sides of the cradle 32. The deck surfaces 34 can be provided with traction enhancing pads 35 (FIG. 1) or the like. Additionally, the deck surface can be provided with textured areas 35*a* (FIG. 6). The pads 35 pads are shown to extend along a central section of the deck 34 and to have a length of about one-half the length of the cradle 32. Of course, the pads 35 could be shorter or longer if desired. A plurality of channels 33 extend across the upper deck surfaces 34 generally perpendicularly to the sides 24 of the port member 20.

Figure 6A:
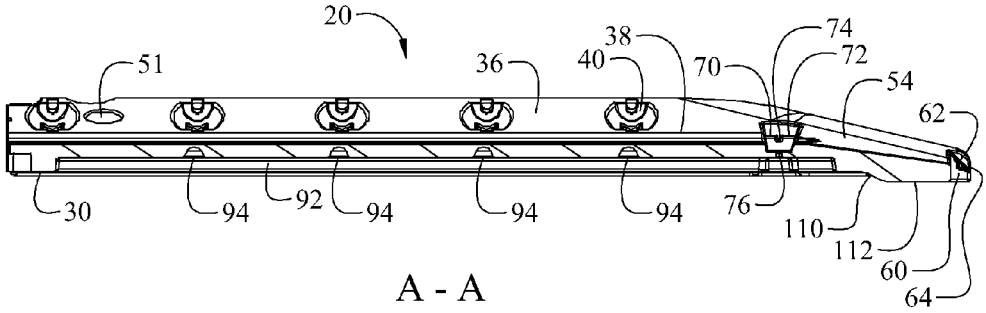
FIGS. 6A-D are cross sectional views of the port entry member taken along lines A-A, B-B, C-C and D-D of FIG. 6, respectively, in which the cross-hatched area is a void or hollow area.

The cradle 32 is defined by a pair of walls 36 which slope downwardly and inwardly to a channel 38 which extends rearwardly from the front end of the port entry member 20 to the forward end of the entrance section 37. The slope of the cradle walls 36 corresponds generally to the dead rise of a watercraft hull. As described in co-pending application Ser. No. 12/125,206, filed May 22, 2008 and entitled "Rollers For Use With Watercraft Ports and Lifts", and which is incorporated herein by reference, to accommodate a greater number of watercraft, the slope of the cradle walls 36 corresponds to a median of common watercraft hull dead rise angles. The bottom of the channel 38 is generally level, as seen in the cross-section of FIG. 6A. Hence, the cradle 32 does not slope from front to back, but rather, is generally horizontal.

A plurality of roller sockets 40 are formed in the cradle walls 36. As seen, the roller sockets 40 are formed in pairs (i.e., two sockets, one on each of the cradle walls 36, and which are aligned with each other). The roller sockets 40 are shown to be evenly spaced apart along the length of the cradle 32, with the forward most socket being spaced slightly rearwardly of the front wall 26. The roller sockets 40 receive rollers 50. The roller sockets 40 are preferably shaped in accordance with the description thereof as set forth in the just noted patent application Ser. No. 12/125,206, which description is incorporated herein by reference. Additionally, the rollers 50 are preferably the rollers described in the just noted patent application Ser. No. 12/125,206, which description is incorporated herein by reference. In particular, the rollers 50 have axles 56 and the sockets 40 have axle receiving channels 48. The socket axle receiving channels 48 and the roller axles 56 are sized such that the rollers 50 can be snap fitted into the sockets 40. Thus, the roller can be easily removed from the socket if necessary, and without the use of tools. The ability to remove rollers 50 from the sockets 44 enhances the ability to configure (or reconfigure) the dock and port assemblies incorporating the port members 20, 220. As seen in FIG. 4, the rollers 50 extend well above the cradle surface 36. In fact, approximately one-half of the roller is above the cradle wall 36.

Figure 6B:
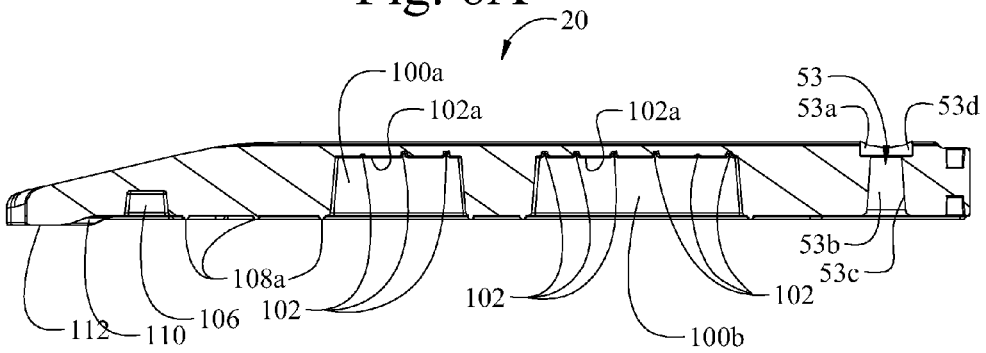
Figure 6C:
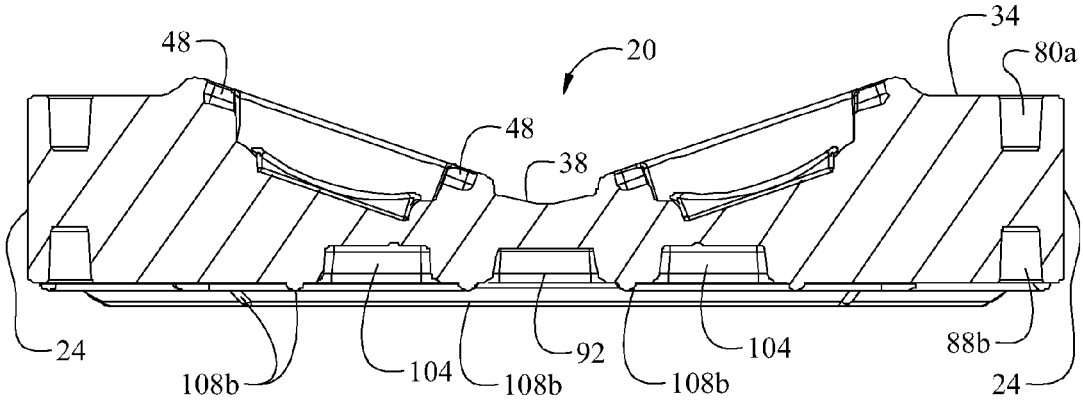
Figure 6D:
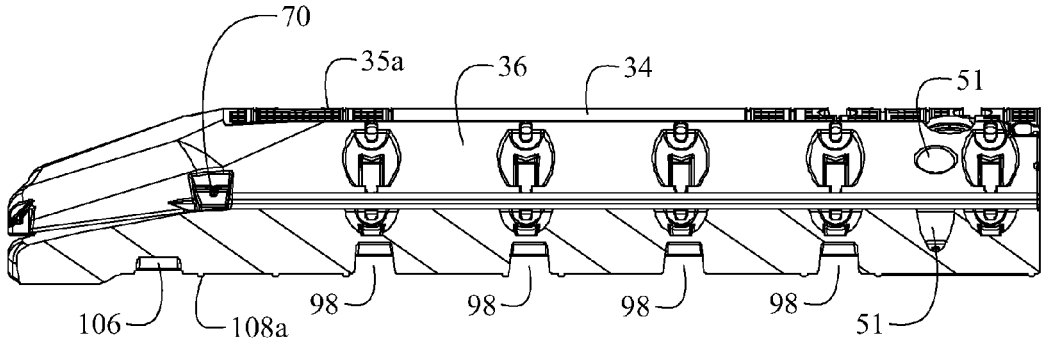
Figure 7:
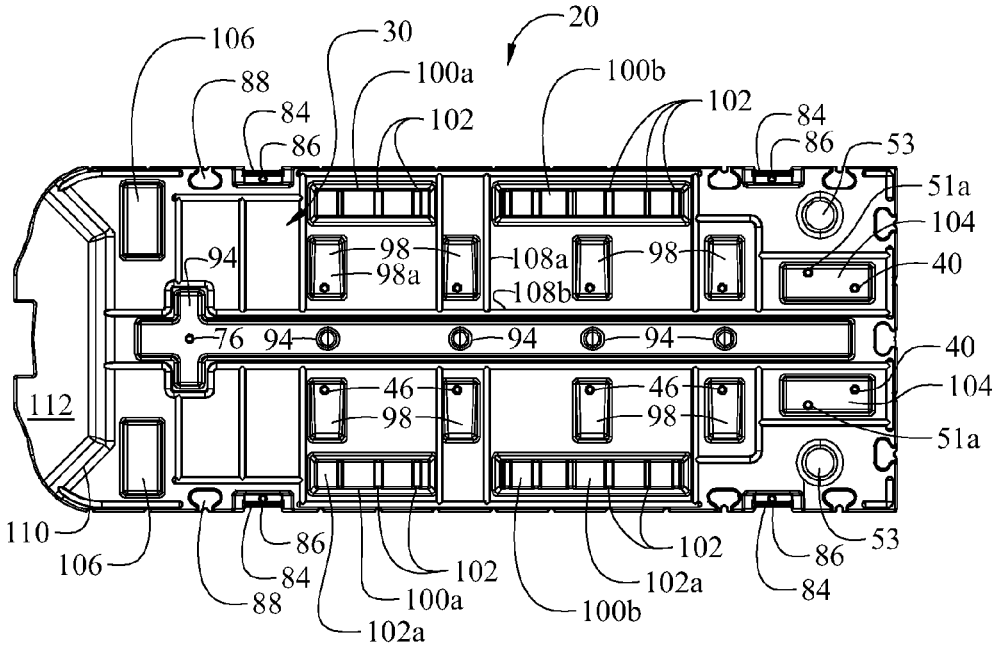
FIG. 7 is a bottom plan view of the port entry member
Figure 8:
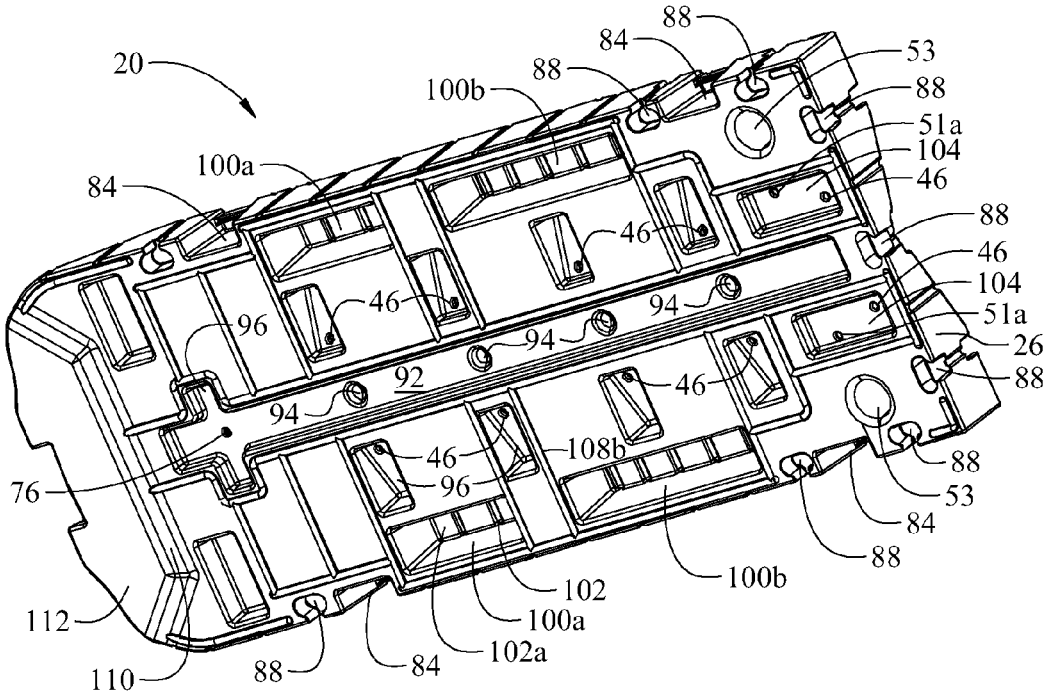
FIG. 8 is a bottom perspective view of the port entry member.
Figure 9:
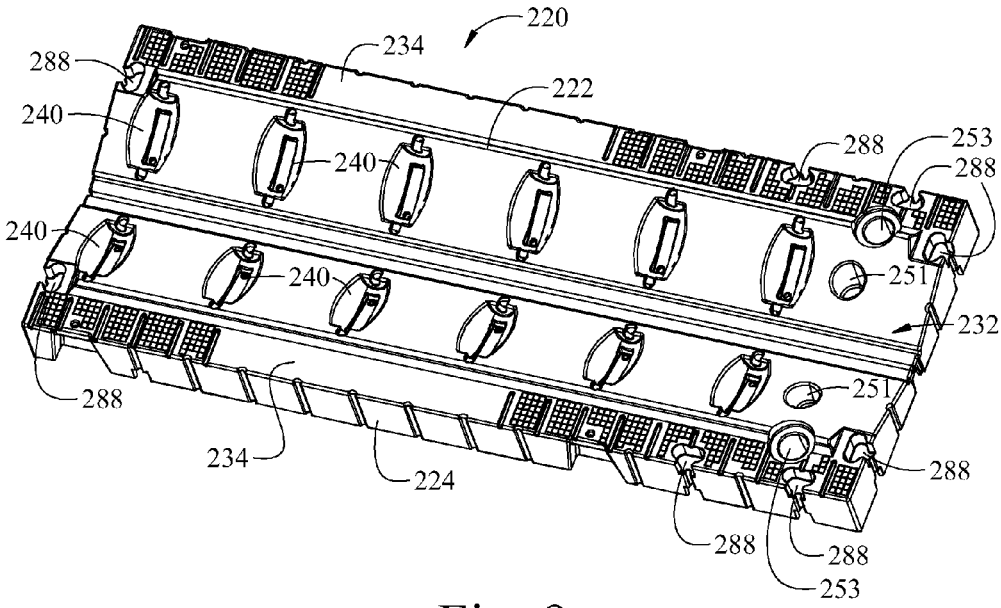
FIG. 9 is a top perspective view of a port extension member.

The port member includes a pair of holes 51 (FIG. 2) which is formed in the cradle walls 36 spaced slightly rearwardly from the forward-most roller socket. The holes 51 are closed at their bottoms, and thus are provided with drainage ports 51*a*. As seen in FIG. 6D, the holes 51 have a slightly curved wall, such that the circumference of the holes 51 decreases towards the bottom of the hole 51. Although the holes 51 have downwardly curving walls, the holes 51 could be generally cylindrical if desired. Furthermore, the holes 51 could be any polygonal shape desired.

Additionally, the port member 20 includes a pair of post holes 53 positioned slightly forward of the holes 51 and slightly behind of the forward-most roller socket 40. As seen in FIG. 6B, the post holes 53 have an upper section 53*a* and a lower section 53*b*. The lower section 53*b* has an upwardly and inwardly tapering side wall 53*c*. That is, the diameter of the lower section 53*b* is greater at the bottom of the port member 20 than at the junction between the two post hole sections 53*a* and 53*b*. The post hole upper section 53*a* is larger in diameter than the lower section 53*b*, and hence, a shoulder 53*d* is formed at the juncture of the two post hole sections. The diameter of the post hole 53 at the shoulder 53*d* is sized to allow a pier post to pass through the hole 53 and to allow the port member 20 to float up and down on the water surface relative to the pier post as water level changes or in response to wave action at the port member 20. The post holes 53 are shown to be generally cylindrical to correspond to the shape of the posts that are commonly used. However, if desired, the post holes 53 could be in other configurations (i.e., square, triangular, etc), as long as the post holes 53 are sized and shaped to allow the pier post to pass therethrough and to permit the port member to move vertically relative to the pier post as water level changes in response to changes in the water depth of the body of water in which the port assembly is located or to accommodate wave action.

Figure 2:
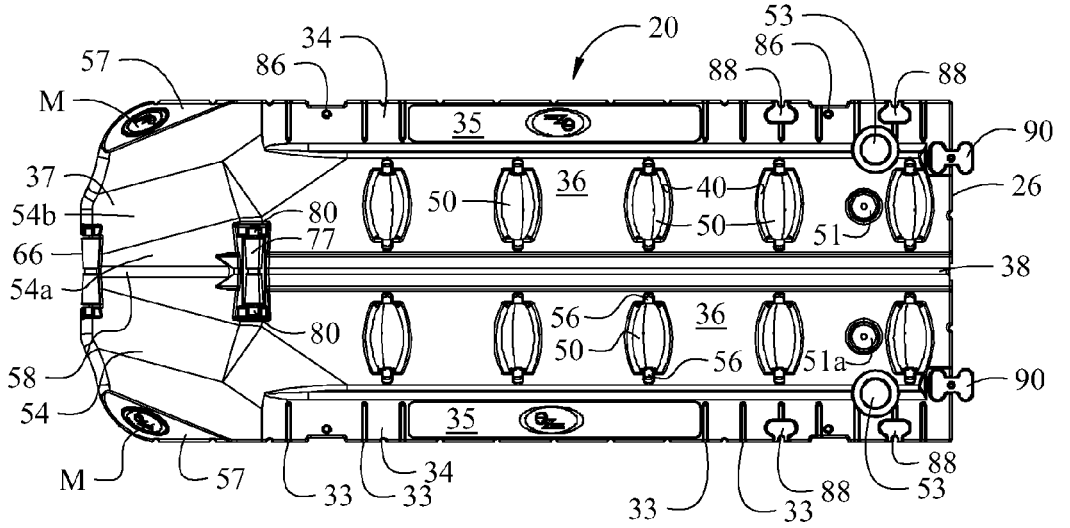
FIG. 2 is a top plan view of the port entry member.
Figure 3:
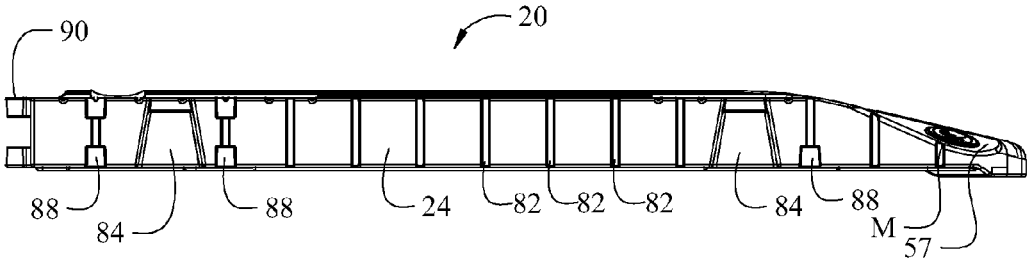
FIG. 3 is a side elevational view of the port entry member.

The entrance section 37, at the back of the port member 20, is fairly wide. As can be seen, at the back of the entrance section, the entrance section extends across substantially eighty percent of the width of the port member. The entrance section is defined by a pair of rearwardly and inwardly sloping surfaces 54 (FIG. 2) which extend from a surface 57. The surface 57 slopes downwardly, outwardly and rearwardly from an outer end of the ramp surface 54. As best seen in FIGS. 3 and 4, the downwardly and outwardly sloped surface 57 is visible when the port member is viewed in side or end elevation. Thus, the surface 57 will be visible to boaters from the water. Hence, the surface 57 can be used, for example, as a place to place a logo or other branding marks M. Additionally, the surface 57 could be used for reflective elements, lights, or identifying indicia (such as port numbers for a series of ports). The surfaces 54 define a ramp which leads into the cradle 32. Actually, the surfaces 54 include an outer portion 54*a* and an inner portion 54*b*. The inward or lateral slope of the inner portion 54*b* is greater than the inward or lateral slope of the outer portion 54*a*, and the inner portions 54*b* are separated by a channel 58. The channel 58 extends forwardly from the back edge of the entrance section substantially the length of the entrance section.

A cut-out 60 (FIG. 6) is formed in the back edge 28 of the port entry member. The cut-out 60 is generally centered relative to the width of the back edge, the port entrance section 37 and the entrance channel 58. Sloped surfaces 62 are formed on opposite sides of the cut-out 60. Axle receiving slots 64 are formed in the surfaces. A roller 66 (FIG. 4) is mounted in the cut-out 60. An axle 68 extends through the roller 66 and is received in the axle receiving slots 64. A plate 70 covers the slots 64 to maintain the axle in the slots (and hence to maintain the roller 66 in the cut-out 60. In an illustrative embodiment, the roller 66 has a variable diameter, such that the diameter of the roller decreases from the outer end of the roller toward the center. At its center, the roller 66 includes a groove 66*a* which effectively separates the roller 66 into left and right halves. The length and rearward slope of the walls 54 of the entrance section 37 are such that the roller 66 is at the water level, or even below the water level when the port member 20 is empty (i.e., without a watercraft on the port member). Because the rear end the of entrance section (i.e., the edge 28 of the port member) is at or below water level, and because the roller 66 is at or below water level, it is easier to drive a PWC onto the port member 20.

A further roller socket 70 (FIG. 6) is positioned at the juncture of the entrance section 37 and the cradle 36. The roller socket 70 is centered relative to the width of the port member 20 and the cradle and entrance section channels 38 and 58, respectively. The roller socket 70 is generally rectangular in top plan. A shoulder 72 (FIG. 6A) is formed on opposite sides of the socket; and an axle receiving slot 74 is formed in each shoulder. The socket 70 also includes a drain hole 76. A roller 77 (FIG. 2) on an axle is mounted in the socket 70. The roller is held in place by plates 80 which are secured to the pocket shoulders 72. The roller 77 is substantially identical to the roller 66, and thus will not be described further.

The side walls 24 and the front end wall 26 of the port member 20 include a plurality of channels 82 which extend generally vertically the height of the port side walls 24. When two port members 20 are connected side-to-side, or when the port member 20 is adjacent a dock member, the channels 82 of the adjacent members will be generally aligned. Hence, the channels 82 will define drain holes between adjacent members to allow water additional avenues to flow off the surface of the port member 20.

Each side wall 24 also includes hand hold area 84 (FIG. 1). The hand hold areas 84 are defined by generally trapezoidal recesses in the side walls 24. As seen, one hand hold area 84 is formed near the front of the port member and a second is formed near the forward end of the port member cradle section. The hand hold areas 84 provide an area for people to lift the port member when the port member is being installed or removed from the water. A hole 86 is formed above each hand hold area 84. The holes 86 provide a place for a cleat to be attached to the port member 20. In place of a cleat, a rope or rope loop can also be fastened to one or more of the holes 86 of the port member 20. If a rope or rope loop is to be secured to the port member, then the rope is passed through the hole 86, and knots are formed in the rope on opposite sides of the hole.

Figure 5:
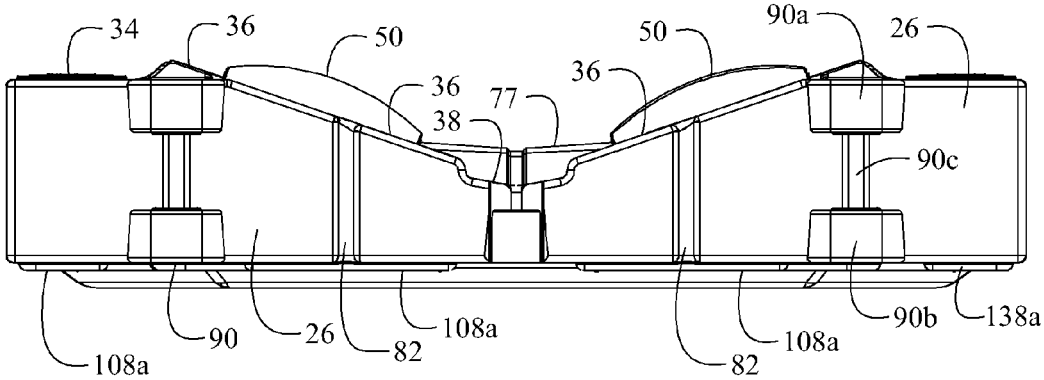
FIG. 5 is a front elevational view of the port entry member.

Lastly, the side walls 24 and the front wall 26 include connector sockets 88. The connector sockets receive connectors 90, two of which are shown in FIG. 1. The connectors 90 are formed complementarily to the connector sockets 88. The connector sockets and the connectors are substantially the same as shown and described in U.S. Pat. No. 5,281,055, but could be as shown and described in U.S. Pat. No. 7,243,608. The description of the connectors from both of these patents is incorporated herein by reference. Generally, the connector comprises a pair of bulbous ends connected together by a narrower section. As shown in FIG. 2, the connector has a generally "dog bone" shape. However, the connector ends could be of any other desired shape, so long as the connector will resist being pulled horizontally out of the connector socket 88. The connector can be a single piece, as shown in the above noted U.S. Pat. No. 7,243,608, or the connector can comprise upper and lower portions 90*a,b* which are connected by a rod 90*c*, as seen in FIG. 5. In this latter instance, the connector socket includes upper and lower socket portions 88*a,b* connected by a channel 88*c*. Additional connector sockets 88 are positioned at the back end of the port member 20 rearwardly of the rear hand hold 84 and at the center of the front wall These connector sockets only have sockets at the bottom of the port, and hence are not used for connecting two port members together or for connecting a port member to a dock member. Rather, the these connector sockets are provided to secure accessories, such as covers, canopies, storage boxes, light poles, etc., to the port member 20.

The bottom 30 (FIGS. 7 and 8) of the port member 20 is somewhat similar to the bottom of the port shown and described in U.S. Pat. No. 7,069,872, which is incorporated herein by reference. The bottom 30 includes an elongate channel 92 extending along the center of the port bottom 30 substantially the full length of the port bottom 30. Several spaced apart cone-shaped indentations 94 are formed in the channel 92. A cross-channel 96 extends across, and generally perpendicularly to, the elongate channel 92. The cross-channel 96 is substantially shorter than the elongate channel 92. A plurality of laterally extending, generally rectangular recesses 98 are formed on opposite sides of the elongate channel 92. The rectangular recesses 98 are positioned generally below the roller sockets 40. The recesses have side and end walls that slope slightly inwardly. Additionally, the upper surface 98*a* slopes from the inner end to the outer end, such that the end wall of the recess closer to the channel 92 is shorter than the end wall of the recess closer to the port side wall 24. A pair of longitudinally extending, generally rectangular recesses 100*a,b* are positioned beneath the port deck surfaces 34. The recesses 100*a,b* are generally similar, except for the fact that recess 100*b* (which is forward or recess 100*a*) is longer than recess 100*a*. The recesses 100*a,b* have generally vertical end walls, however, the side walls slope inwardly slightly, such that the opposed side walls of a recess 100*a,b* are closer together at the top of the recess than at the bottom of the recess. The recesses 100*a,b* include a plurality of channels 102 which extend across the upper surface 102*a* of the recesses 100*a,b*. The channels 102 are generally equally spaced apart and extend between the side walls of the recesses. The tops of the channels 102 contact, or are spaced slightly below, the top surface 22 of the port member 20, and thus provide some support for the port upper surface 22. An additional pair of longitudinally extending generally rectangular recesses 104 is positioned on opposite sides of the elongate channel 92 near the forward end of the port member 20. The recesses 104 are positioned generally beneath the forward most roller sockets 40 and the holes 51 and between the post holes 53. An additional pair of laterally extending generally rectangular recesses 106 is positioned below the entrance section 37. The port bottom includes laterally and longitudinally extending ribs or ridges 108*a,b,* respectively. The ridges 108*a,b* form a series of boxes. Some of the boxes surround single recesses, some surround multiple recesses, and some do not surround any recesses. A series of the ridges outline the elongate channel 92 and the cross channel 96.

Lastly, the port bottom 30 includes a sloped wall 110 which leads to a lower surface 112. The sloped wall 110 and lower surface 112, in conjunction with the port side walls 24 and end edge 28 form an enlarged hollow section in the port (as seen, for example, in FIG. 6A) below the entrance section 37. This enlarged hollow section provided for increased buoyancy at the entrance to the port member 20. When a watercraft is cradled in the port member, the motor, and hence heaviest part of the watercraft is at the back of the watercraft, and is therefor positioned on or near the entrance section 37. Thus, this enlarged hollow section provides increased buoyancy for the heaviest part of the watercraft.

As noted above, the port member 20 is hollow, and thus is buoyant and will support a watercraft. The various recesses in the bottom surface 30 provide additional stability to the port member to reduce rocking of the port member, for example, in response to small waves.

Figure 10:
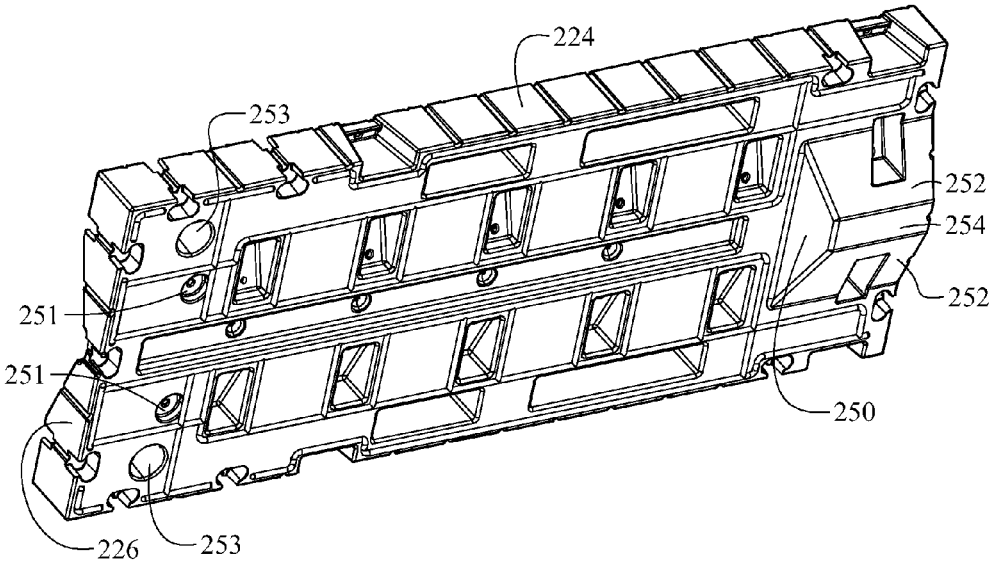
FIG. 10 is a bottom perspective view of the port extension member.
Figure 11:
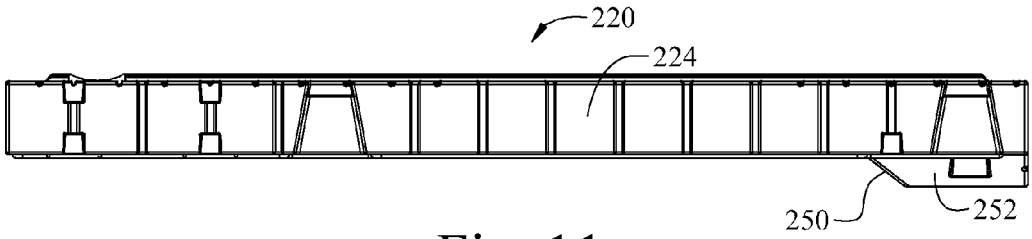
FIG. 11 is a side elevational view of the port extension member.
Figure 12:
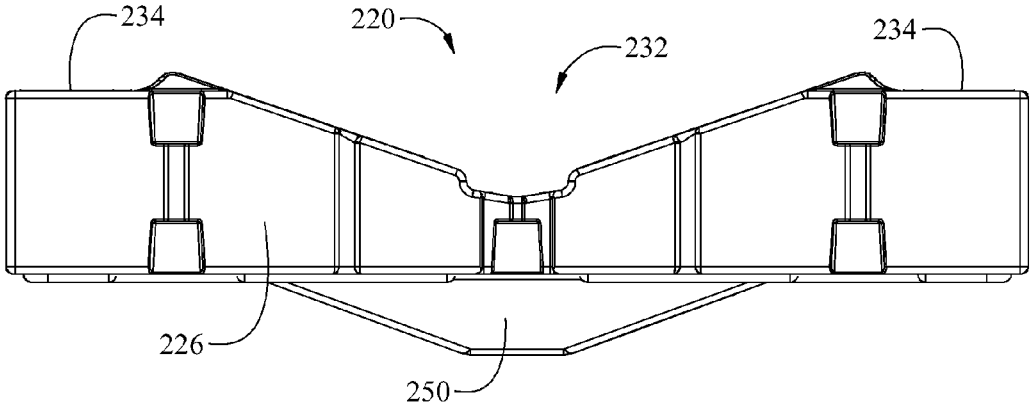
FIG. 12 is a front elevational view of the port extension member.
Figure 13:
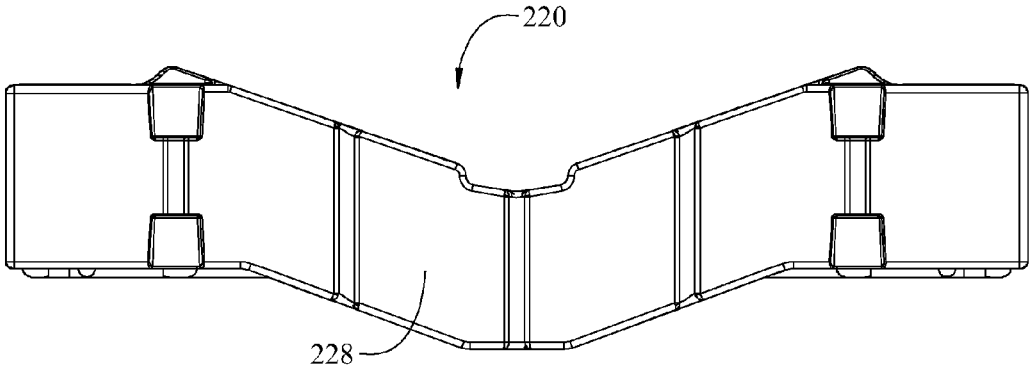
FIG. 13 is a rear elevational view of the port extension member.
Figure 14:
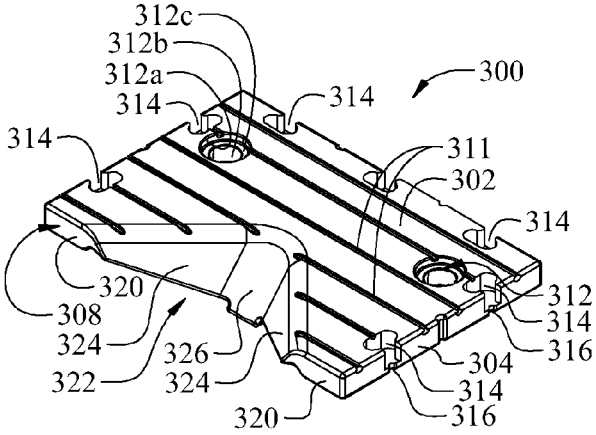
FIG. 14 is a rear perspective view of a full bow stop for use with the port members.
Figure 15:
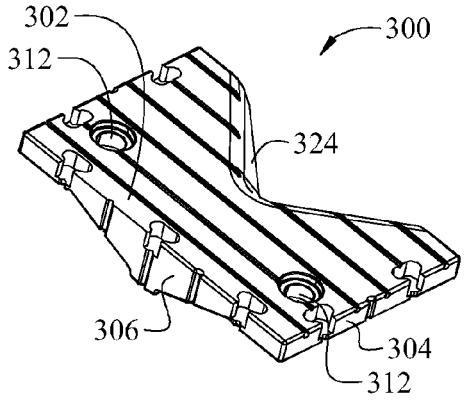
FIG. 15 is a front perspective view of the full bow stop.
Figure 16:
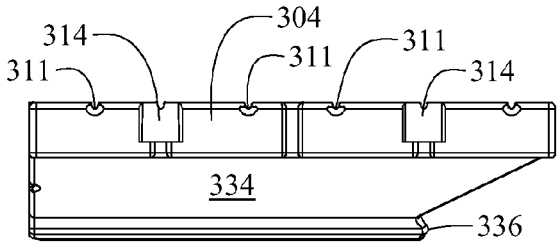
FIG. 16 is a side elevational view of the full bow stop.
Figure 17:
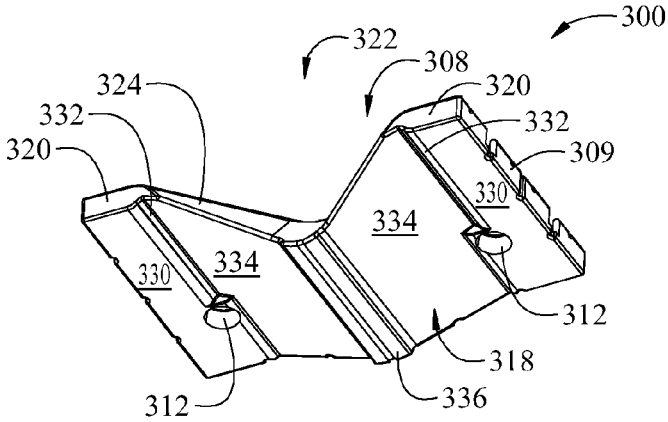
FIG. 17 is a bottom perspective view of the full bow stop.

The port extension member 220 is shown generally in FIGS. 9-13. The port extension member 220 is substantially similar to the entry member 20, and hence will not be described in quite as much detail. The extension member 220 includes a top surface 222, side walls 224, a front wall 226, a back wall 228 and a bottom surface 230. The top surface 222 is comprised of a cradle 232 which is substantially identical to the cradle 32 of the entrance member 20; however, the cradle 232 of the extension port extends the full length of the extension member 220 (and opens out the front and back walls of the extension member). Because the cradle 232 is longer than the cradle 32, the cradle 232 includes more roller sockets 240, which are identical to the roller sockets 40. On either side of the cradle 232, the extension member 220 includes deck surfaces 234. At the forward end of the cradle, the extension member 220 includes holes 251 and post holes 253. The sides 224 and front 226 are identical in construction to the sides 24 and front 26 of the port entrance member 20, and hence will not be described. The back wall 228 as seen is generally V-shaped. That is, rather than having a straight or flat bottom, as at the front wall, the bottom edges of the back wall are generally parallel to the top edges of the back wall. As seen in FIGS. 10 and 11, the extension bottom includes a downwardly and rearwardly sloping surface 250 and downwardly and inwardly sloping surfaces 252 which are separated by a generally flat surface 254. The surfaces 250, 252 and 254, in conjunction with the back surface 228, define an enlarged hollow area to provide more buoyancy at the back of the port extension member 220.

The extension member includes connector sockets 288 at the front, back and side walls. The connector sockets 288 are identical to the sockets 88 of the entrance member 20. Hence, extension members can be connected together in tandem or side-by-side, or, an extension member can be connected to the front of an entry member to form an elongate, tandem port assembly.

As noted above, the port system includes two bow stops which can be positioned on the port members 20, 220. The first bow stop is a full bow stop 300 and the second bow stop is a smaller bow stop 350, 350', 350". The full bow stop 300 is intended to be essentially fixed to the port member. While it can be removed, it is not intended to be removed on a frequent basis. However, the smaller, half, bow stop 350, 350', 350" is intended to be removed regularly.

The full bow stop 300 (FIGS. 14-17) includes a top surface 302, side surfaces 304, a front surface 306, a back surface 308, and a bottom surface 310. The bow stop has a width equal to the width of the port members 20, 200, and a length sufficient to cover the forward two roller sockets 40 of the entrance member 20 or the forward most roller socket 240 of the extension member 220. The top surface is generally flat, and includes channels 311 which extend across the top surface. Post holes 312 extend from the top surface through to the bottom surface. The post holes 312 are positioned on the bow stop 300 to be aligned with the post holes 53, 253 of the port entrance member or extension member, respectively, when positioned on either of the two port members. As with the post holes 53, 253, the post holes 312 have an upper section 312*a* and a lower section 312*b* which is smaller in diameter. Hence, a shoulder 312*c* is formed at the bottom of the upper section 312*a*. Connector sockets 314 are positioned at the front and sides of the bow stop. The connector sockets 314 are identical in shape to the connector sockets 88 and are positioned to be vertically aligned with the front and side connector sockets of an entrance member 20 or extension member 220 when positioned thereon. Although the bow stop 300 is shown with a generally flat top surface 302, the top surface could be provided with modifications such that the surface is not all flat. For example, a storage compartment could be formed in part of the top surface. Such a storage compartment would represent a raised area on the top surface 302.

The back surface 308 has generally vertical wall sections 320 at the outer ends of the bow stop 300. These vertical sections have a width approximately equal to the width of the deck surfaces 34, 234 of the entry and extension members 20, 220. The wall sections 320 are connected by a generally V-shaped section 322 defined by a pair of outwardly and downwardly sloping walls 324 connected by a generally U-shaped portion 326, which also slopes downwardly. Hence, the walls 324 slope in both a vertical plane and in a horizontal plane. The sloped shape of the V-shaped section 322 approximates the shape of a bow of a watercraft, such as a PWC.

The bottom surface 310 of the bulk head 300 is shaped complementarily to the upper surface 22, 222 of the port entry and extension members 20, 220. To this end, the bottom surface has outer generally horizontal surfaces 330 which are sized to overlie the deck surfaces 34, 234 of the entry and extension members 20, 220. Because the deck surfaces 34, 234 are below the outer ends of the cradle walls 36, 236, the bow stop 300 has a surface 332 that curves or slopes upwardly from the inner edge of the outer surfaces 330. Surfaces 334 extend diagonally inwardly and downwardly from the inner edge of the surfaces 332. The surfaces 334 have a slope and shape corresponding substantially to the slope and shape of the cradle walls 36, 236. The inner ends of the sloped surfaces 334 are connected by a rib 336 which is shaped generally complementarily to the cradle channel 38.

In use, the full bow stop 300 is placed on a port member (either the entrance member 20 or the extension member 220) with the forward end of the bow stop flush with the forward end 26, 226 of the member 20,220. As noted, the bottom surface 330 of the bow stop is shaped correspondingly to the upper surface of the port members. Thus, the rib 336 will be received in the cradle channel 38, and the surfaces 330 and 334 will generally rest on their corresponding surfaces 34, 234 and 36, 236 of the port member 20, 220. The fit of the bow stop 300 on the port member will help align the bow stop postholes 312 with the postholes 53, 253 of the port members 20, 200 and the connector sockets 314 with the port member connector sockets 88, 288. The bow stop 300 is secured to the port member 20,220 by means of the connectors 90. A full connector 90 (i.e., a full dog-bone connector as seen in FIG. 1) can be used if the port member with the bow stop 300 is to be connected to another port member 20,220 or if the port member is to be connected to a dock member. If the port member is to be used by itself, then a half connector can be used, such as is used to connect accessories to the port member or dock members. As noted above, the bottom surface 330 of the bow stop 300 lies adjacent the upper surface 22, 222 of the port member. Hence, the roller sockets that lie beneath the bow stop must not have any rollers in them; otherwise the rollers will interfere with the placement of the bow stop on the port member. The bow stop bottom surface 330 could be provided with recesses which would receive the rollers covered by the bow stop. This would eliminate the need to remove the rollers upon installation of the full bow stop 300. The rollers closest to the bow stop could be removed if desired. In this instance, the port can be provided with a cover plate (not shown) which could snap into place to cover the socket.

Figure 18A:
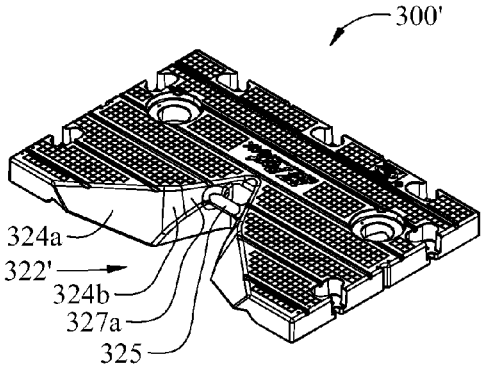
FIGS. 18A-D are back perspective, bottom perspective, top plan and bottom plan views of an alternative design of the full bow stop.
Figure 18B:
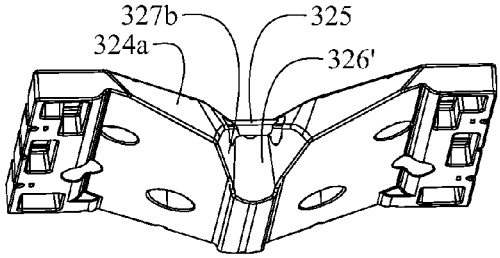
Figure 18C:
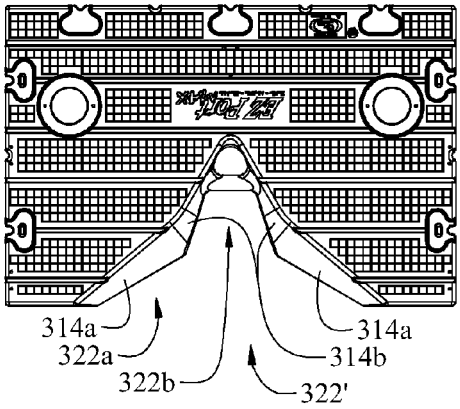
Figure 18D:
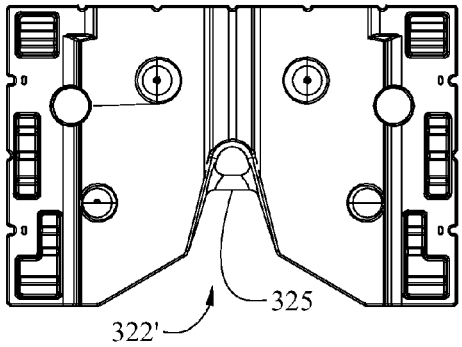

An alternative full bow stop 300" is shown in FIGS. 18A-E. The primary difference between the bow stop 300 (FIGS. 14-17) and the bow stop 300' is the shape or configuration of the V-shaped section 322' which receives the bow of a watercraft. As best seen in FIGS. 18C and 18D, the watercraft bow receiving section 322' includes a first or entry portion 322*a* which leads into a narrower inner portion 322*b*. A curved portion 326' joins the ends of the inner portions 322*b*.The entry portion 322*a* is defined by a pair of inwardly sloping walls 324*a* and the inner portion 322*b* is defined by a pair of more steeply angled walls 324*b*. Finally, the inner portion walls 324*b* are defined by upper portions 327*a* and lower portions 327*b*. The lower portion 327*b* is more vertically oriented, which the upper portion 327*a* slopes inwardly from the deck surface of the bow stop 300'. Lastly, a bar 325 extends between the walls of the inner portion 322*b* just forward of the curved portion 326. Additionally, as can be seen, the deck surface of the bow stop is provided with a textured surface.

The small bow stop 350 is shown in FIGS. 19-24. The bow stop 350, as will be described below, is intended to be easily removable. It is, as noted, smaller than the full bow stop 300, and has a width approximately equal to the width of the cradle 32, 232. The bow stop 350 has a generally flat top surface 352, a front surface 354 which slopes rearwardly and downwardly, side edges 356, a back surface 358, and a bottom surface 360. Holes 361 extend through the bow stop, from the top surface 352 to the bottom surface 360. The holes 361 can accept fasteners (such as bolts, screws, or the like) to fix the bow stop 350 to the port member 20, 220, should that be desired.

Figure 19:
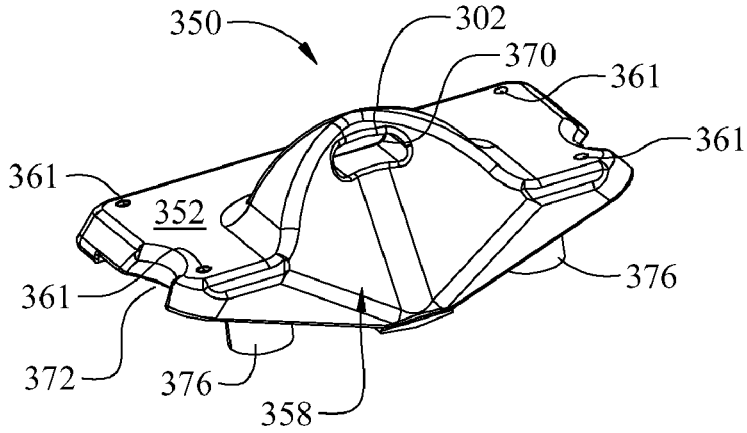
FIG. 19 is a rear perspective view of a small bow stop for use with the port members.
Figure 20:
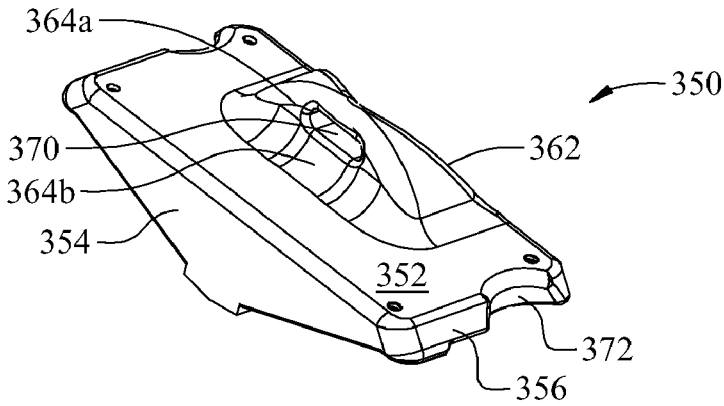
FIG. 20 is a front perspective view of the small bow stop.
Figure 21:
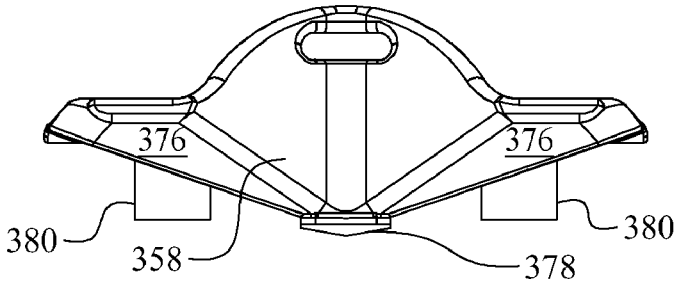
FIG. 21 is a rear elevational view of the small bow stop.
Figure 22:
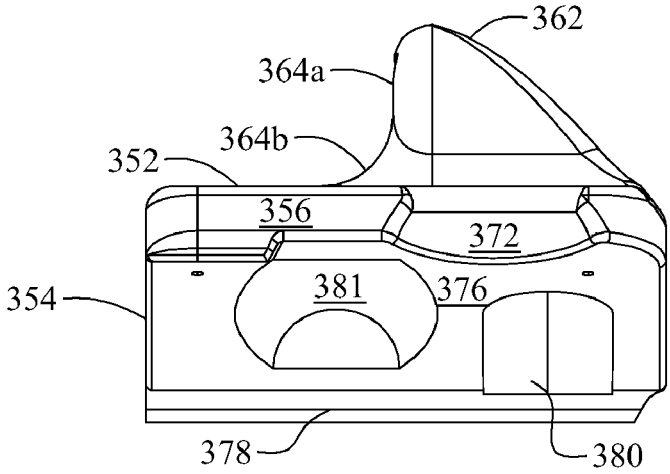
FIG. 22 is a side elevational view of the small bow stop.
Figure 23:
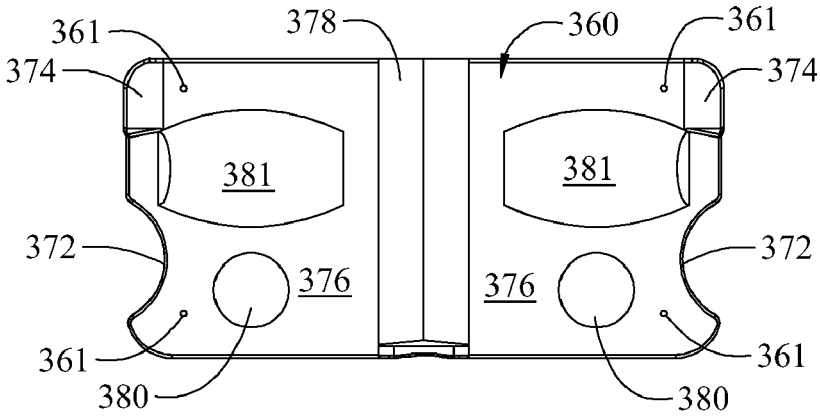
FIG. 23 is a bottom plan view of the small bow stop.
Figure 24:
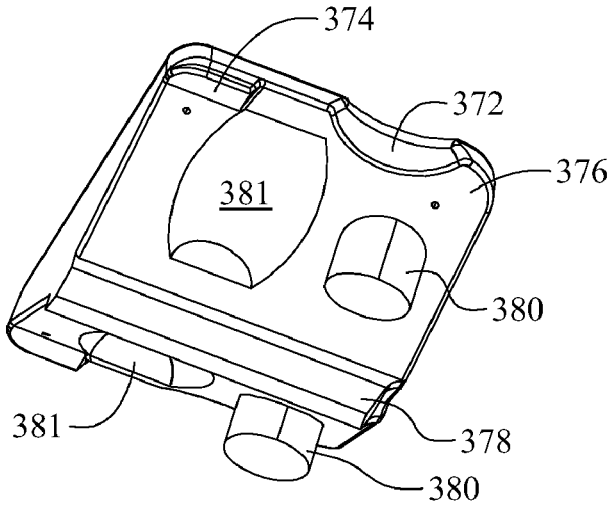
FIG. 24 is a bottom perspective view of the small bow stop.

A handle member 362 rises up from the top surface. The handle member has a front-to-back width, at its base, of about one-half the front-to-back width of the bow stop top surface. The front surface of the handle member has an upper generally vertical section 364*a* and a lower section 364*b* which curves to meet the bow stop upper surface 352. The handle member back surface forms part of the back surface 358 of the bow stop. The handle member/bow stop back surface 358 curves inwardly from its outer edges and downwardly and rearwardly from its upper edges. To this end, the surface 358 approximates the shape of a bow of a watercraft, such as a PWC, to receive a PWC bow. As seen in FIG. 27A, the back surface can narrow considerably, such that at the bottom of the rear surface, the rear surface has a width which will allow it to fit between the roller sockets 40 of the port members. In this example, the back surface in essence forms a rearwardly extending tongue. As seen in FIGS. 19 and 22 the back surface 358 which receives the watercraft bow need not be quite so long, and can extend to a point approximately mid-way between the forward most rollers of the port member 20, 220. At its top, the handle member 362 includes a hole 370. The hole 370 is positioned on the handle member, and sized such that a user can grasp the handle member and lift the bow stop.

Arced cutouts 372 are formed in the side edges 356. The width of the bow stop 350 is such that it would cover the post holes 53, 253 of the port members. Hence, the cutouts 372 are positioned to be aligned with the port member post holes 53, 253 so that the post holes will not be covered by the bow stop 350. Additionally, the cutouts 372 can engage the posts passing through the post holes, and the engagement of the bow stop with the postholes can help maintain the bow stop in place on the port member.

The bottom surface 360, like the bottom surface of the bow stop 300, is shaped complementarily to the cradle 32, 232 of the port members 20, 220. The bottom surface includes a small flat surface 374 which lies on top of the deck surfaces 34, 234. The majority of the bottom surface is defined by surfaces 376 which slope inwardly and downwardly. As with the full bow stop 300, the small bow stop includes a rib 378 at its center which is shaped complementarily to the port member cradle channel 38, and which is received in the cradle channel when the bow stop is placed on the port member 20, 220. The sloping surfaces have a slope approximately equal to the slope of the cradle surfaces 36, 236. To facilitate positioning of the bow stop 350 on the port member, the bow stop includes a pair of posts 380 which extend downwardly from the sloped surface 376 and are positioned, sized and shaped to be received in the holes 51, 251 of the port members 20, 220. The posts 380 are generally similar in shape to the port member holes 51, 251. Both the posts 380 and the holes 51, 251 are shown to be generally circular in plan. However, the posts 380 could be in other shapes (square, triangular, polygonal, etc) if desired, as long as the posts 380 can be received within the holes 51, 251 of the members 20, 220. Additionally, the bow stop includes recesses 381 in the sloped surfaces 376 which are sized and shaped complimentarily to the roller sockets 40 and are positioned to be aligned with the roller sockets 40 when the bow stop 350 is placed on the port member. The recesses 381 have curved surfaces similar to the curved surface of the roller sockets 40, such that the top portion of a roller 50 can be received in the recess 381 when the bow stop 350 is placed on a port member. Hence, placement of the bow stop 350 on a port member does not require that rollers 50 be removed from the port member. Rather, when the bow stop 350 is placed on the port member, the rollers 50 in the forward most sockets 40 will be enclosed by the bow stop recesses 381. As noted above, the full bow stop 300 could be provided with similar recesses. The engagement of the posts 381 with the holes 51, 251 and of the cutouts 372 with support posts is such that the bow stop 350 can be easily removed from the port member for reasons as will be described below. To prevent the bow stop from inadvertently being lost, the bow stop can be tethered to the port member. For example a tether 373 (in the form of a rope, bungee cord, etc.) can extend either through the handle hole 370 or one of the corner holes 361 of the bow stop 350 at one end of the tether, and at the other end, the tether can extend through the hole 86 of one of the hand hold areas 84.

Figure 25A:
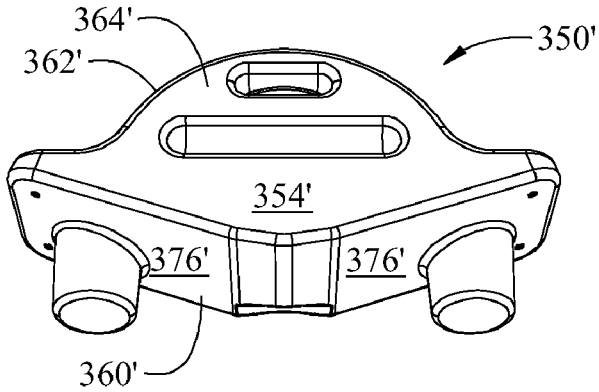
FIGS. 25A-C are bottom perspective, top perspective and side elevational views, respectively, of an alternative embodiment of the small bow stop.
Figure 25B:
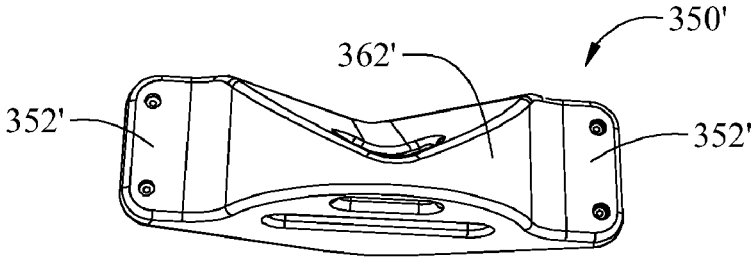
Figure 25C:
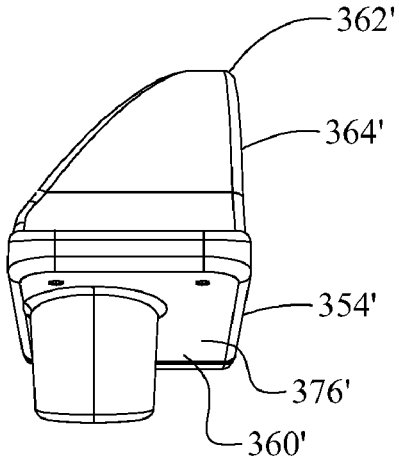

An alternative embodiment of the small bow stop is shown in FIGS. 25A-C. The bow stop 350' is substantially identical to the bow stop 350. However, it is much narrower (from front to back) and hence, the top flat surface 352' does not extend forwardly of the handle section 362'. Thus, the front of the bow stop 350' is generally vertical, and is defined by the front surface 364' of the handle and the front 354' of the bow stop body. The front to back width of the bow stop 350' is sized such that the bow stop 350' will not cover any of the rollers 50 of the port member 20, 220. Hence, the sloped surface 376' of the bottom surface 360' do not include cavities, such as the roller receiving cavities 381 of the bow stop 350. Because the bow stop 350' is smaller than the bow stop 350, it will be lighter, and hence easier to remove from the port member 20, 220 during normal use of the port member 20, 220.

The small bow stops 350 and 350' as noted, are generally the same except from their front-to-back length. The front-to-back length could be varied such that the bow stop length is between the lengths of the two bow stops 350, 350'. In this instance, such a bow stop would have some flat surface forward of the handle 362, 362', however, such a flat surface would not be as long as the surface 352 of the bow stop 350.

Figure 26A:
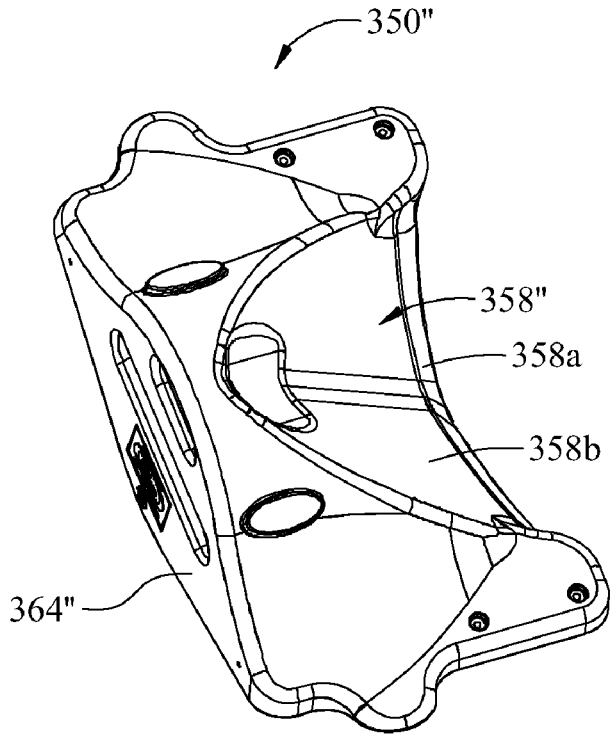
FIGS. 26A-B are top perspective and bottom plan views of a second alternative small bow stop sized between the bow stop of FIGS. 18-23 and FIGS. 24A-C.
Figure 26B:
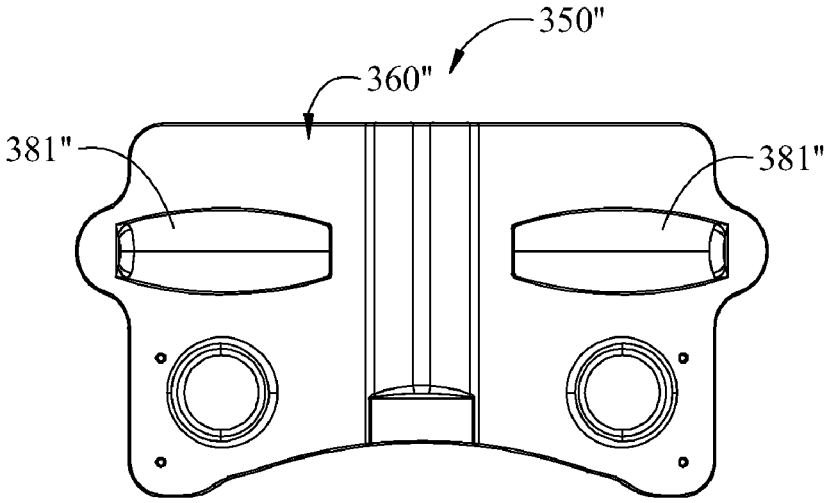

Another alternative small bow stop 350" is shown in FIGS. 26A-B. The bow stop 350" is between the bow stops 350 and 350' in size, and has commonalities with both the small bow stops 350 and 350'. The bow stop 350" has a front-to-back length equal to the front-to-back length of the small bow stop 350. Thus, when the bow stop 350" is placed on a port member 20,220, the bow stop 350" will cover the forward most rollers on the port member. Hence, like the bow stop 350, the bottom 360" is provided with pockets 381" which are positioned to be aligned with the roller sockets 40, 240 of the port members 20, 220. In view of this commonality, the bottom 360" of the bow stop 350" is identical to the bottom 360 of the bow stop 350. This can be seen from a comparison of FIGS. 26B and 23. Like the bow stop 350', the bow stop 350" has a flat front surface 364" and a back surface 358" which essentially extends length of the bow stop from the back edge of the bow stop. As can be seen by comparing FIGS. 26A and 25B, the bow stop back surface 358" is longer and has a shallower slope. In fact, the bow stop back surface 358" can be divided into a lower portion 358*a* and an upper portion 358*b*. The lower portion 358*a* has a steeper slope than the upper portion 358*b*; and, in fact, the slope of the lower portion 358*a* corresponds generally to the slope of the back surface of the bow stop 350. The shallower back surface 358" defines a longer bow receiving portion for the bow stop. This allows for the bow stop to receive a wider variety of watercraft. The bow stop 350", like the bow stop 350', is narrower than the bow stop 350. Thus, the bow stop 350" does not need the cutouts on the sides to accommodate pier posts. This will make the bow stop 350" somewhat easier to position on, and remove from, the port member 20, 220. However, due to the decreased side-to-side width, the bow stop 350" has outwardly extending protrusions which accommodate the pockets 381", as seen in FIG. 26B.

Figure 27B:
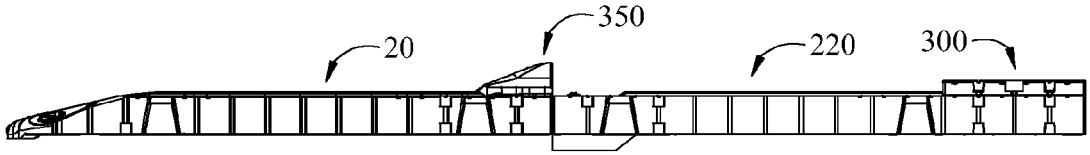

As noted above, the use of the two types of port members (an entrance member 20 and an extension member 220) allows for watercraft ports to be configured in numerous ways. FIGS. 27A-B show an entrance member 20 and an extension member 220 connected in tandem. The extension member 220 is provided with a full bow stop 300 and the entrance member 20 is provided with a small bow stop 350". This configuration allows for two watercraft to be stored in tandem on the tandem port assembly. To allow the first (or forward) watercraft onto the port assembly, the small bow stop 350" will be lifted out of the way, and the watercraft can then be driven onto the tandem port into the forward position. The small bow stop can then be repositioned on the entry member 20, and the second (or rear) watercraft can be driven on to the port. If the small bow stop is tethered to the port entry member 20, then, when the watercraft are driven off the port assembly, the small bow stop can be allowed to float in the water without fear of loosing the bow stop. Although this figure shows one extension member 220, it will be appreciated that two, three or more extension members can be connected in tandem with an entry member 20 to make a port assembly of a desired length.

Figure 28A:
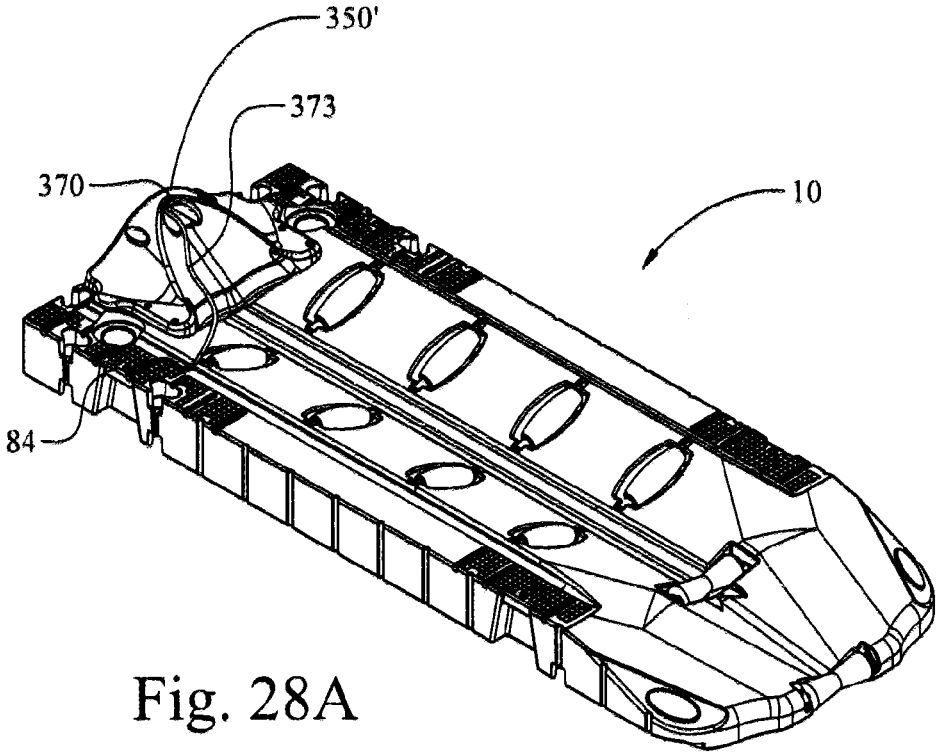
FIGS. 28A-F show views of some possible different configurations of the port members and bow stops.
Figure 28B:
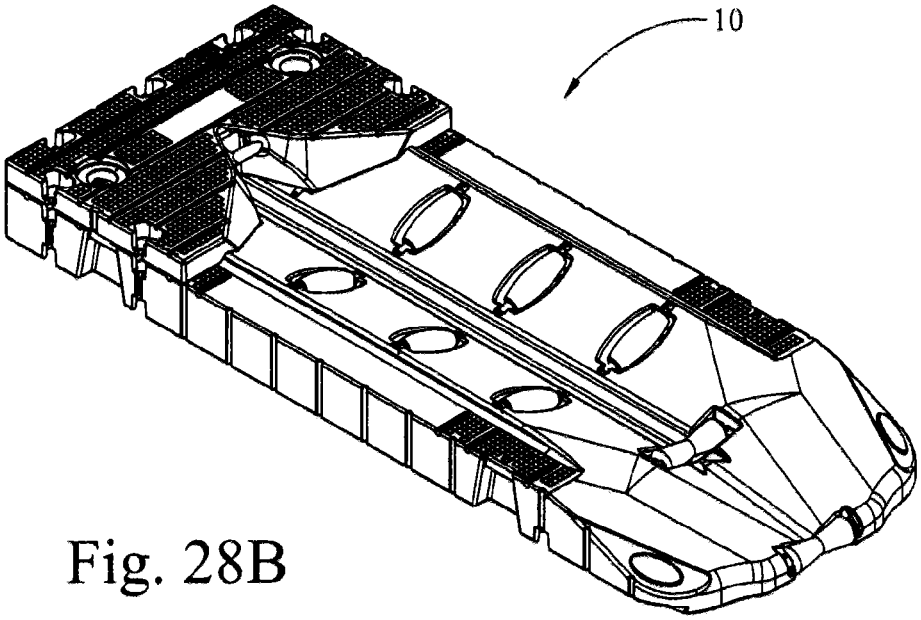
Figure 28C:
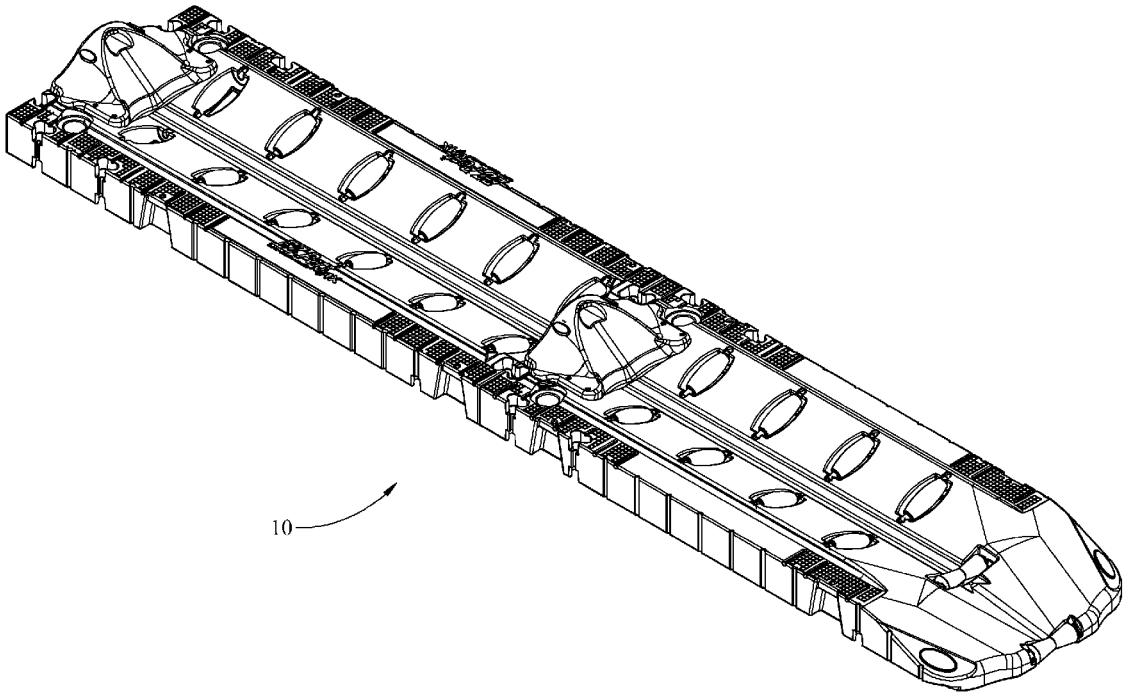
Figure 28D:
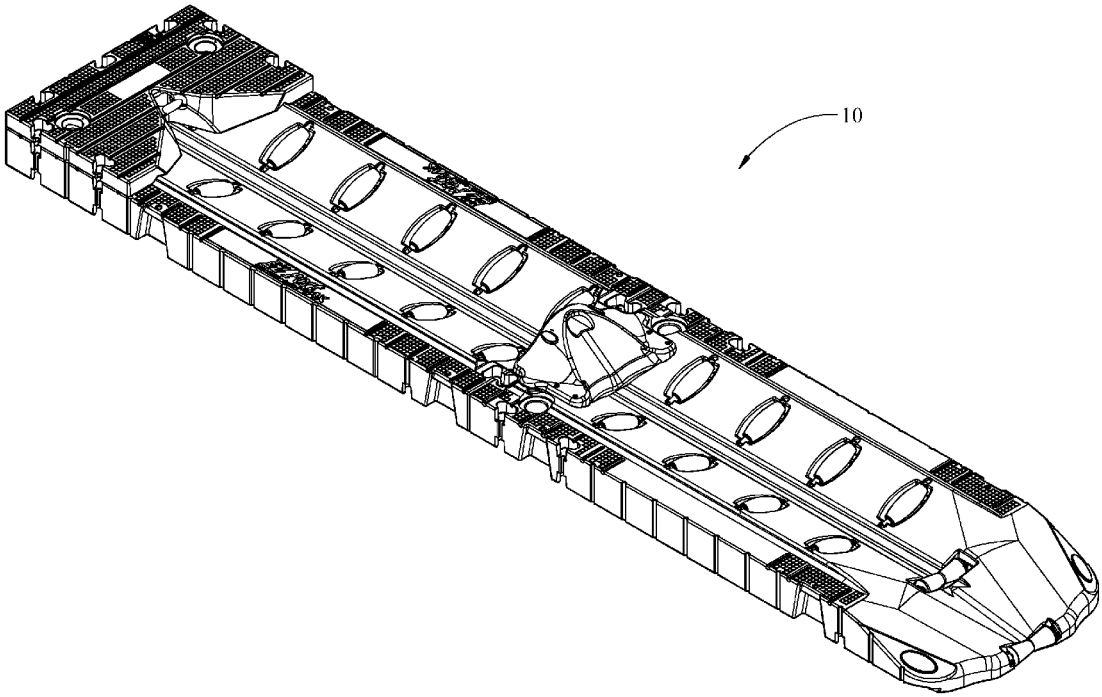
Figure 28E:
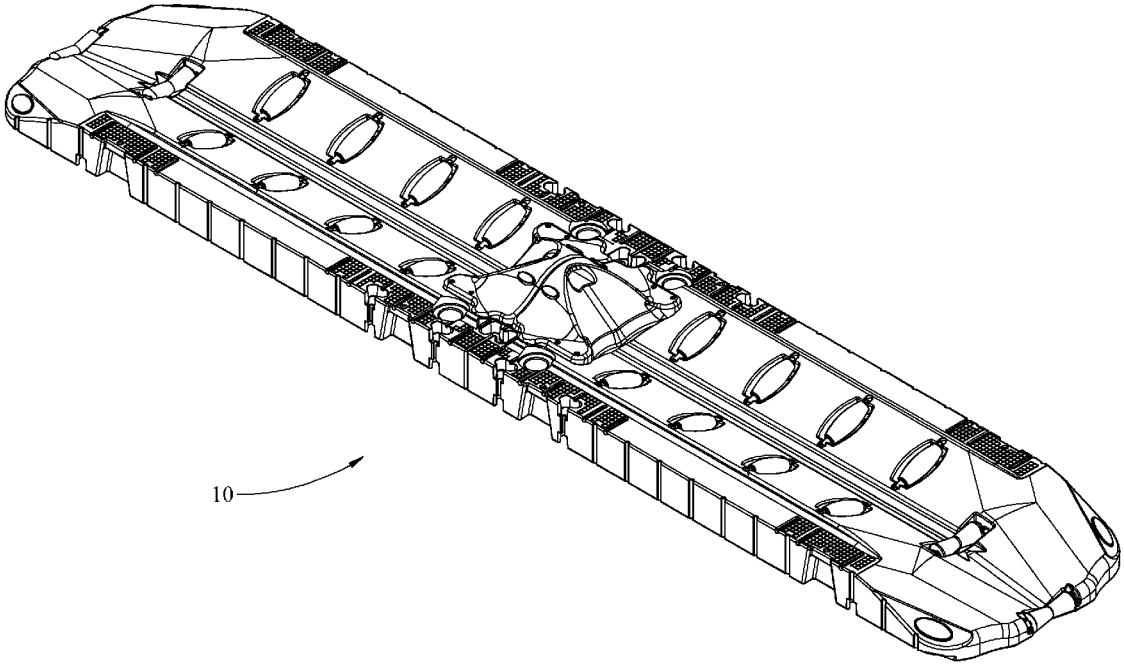
Figure 28F:
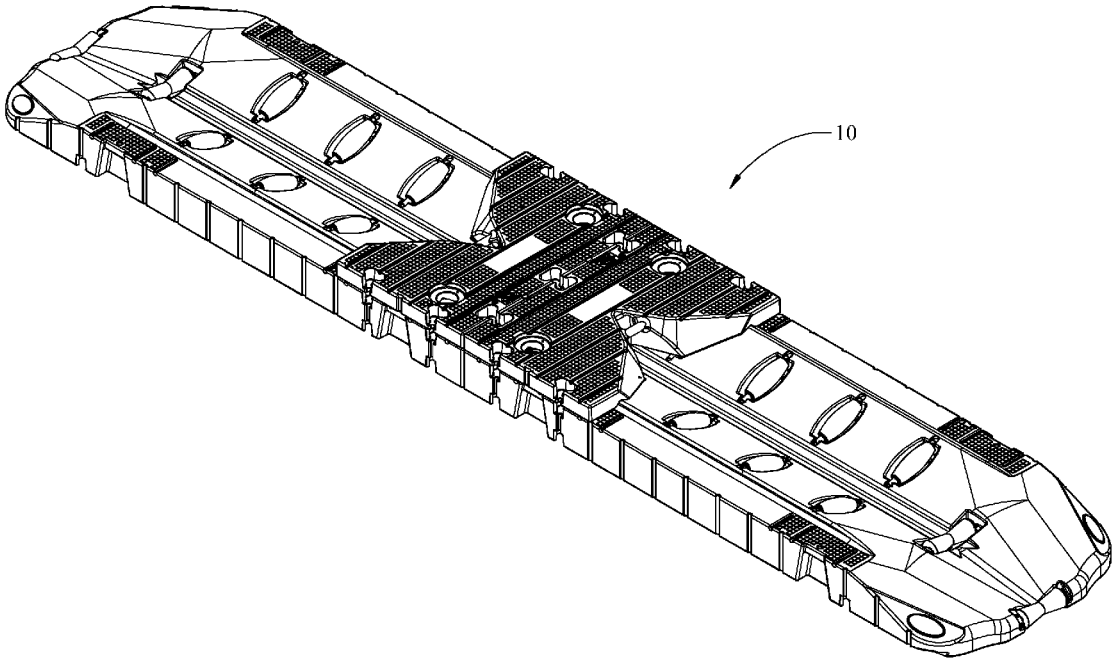

In other configurations, the entry member can be used alone with either the small bow stop 350' (FIG. 28A) or the full bow stop 300 (FIG. 28B). In the configuration shown in FIGS. 27A-B (and FIG. 28D), the full bow stop in the member 220 can be replaced with a small bow stop, as shown in FIG. 28C. Two entry members 20 can be connected together head-to-head with no bow stop, with one small bow stop, with two small bow stops (FIG. 28E), or with two full bow stops (FIG. 28F). If two entry members are connected together head-to-head with either no bow stops or just the one small bow stop, then the configuration would allow for a watercraft to be driven on to the port assembly and then driven off the port assembly in a forward direction. This could be beneficial for servicing of watercraft. In FIGS. 28A-E, the port assemblies are shown by themselves. The port assemblies shown in FIGS. 28A-E use the small bow stop 350' when small bow stops are used. Either of the other small bow stops 350, 350" could also have been used. However, the bow stop 350' has the added benefit that two of the bow stops can be placed adjacent each other, as seen in FIG. 28E. The two small bow stops 350" could also be placed face-to-face in the same manner.

Figure 29A:
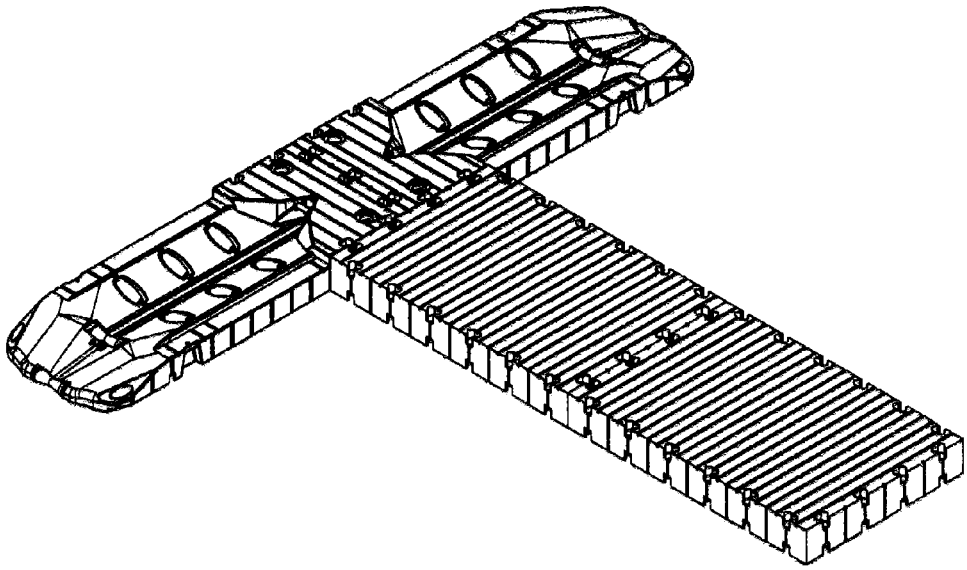
FIGS. 29A-D are plan views of possible configurations of the port members assembled into or connected to dock members.
Figure 29B:
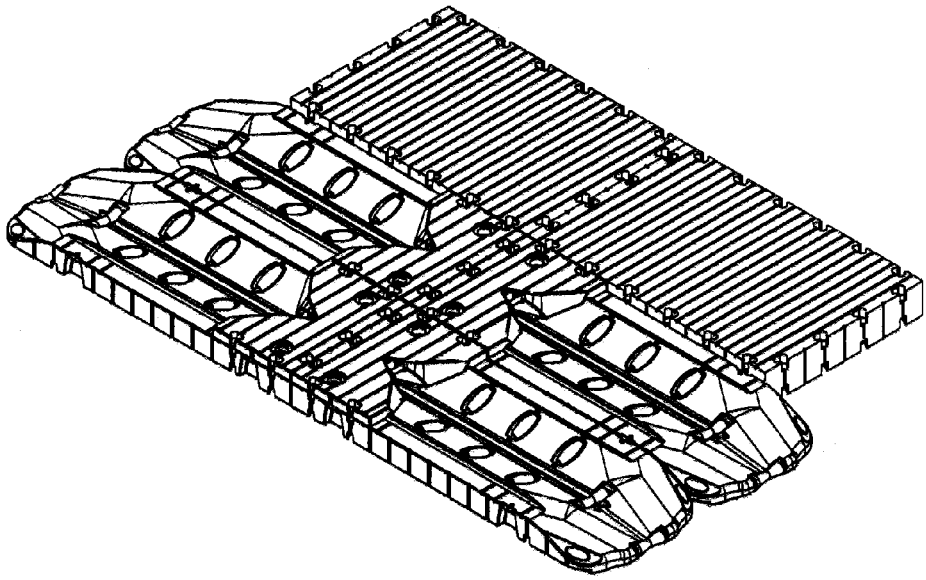
Figure 29C:
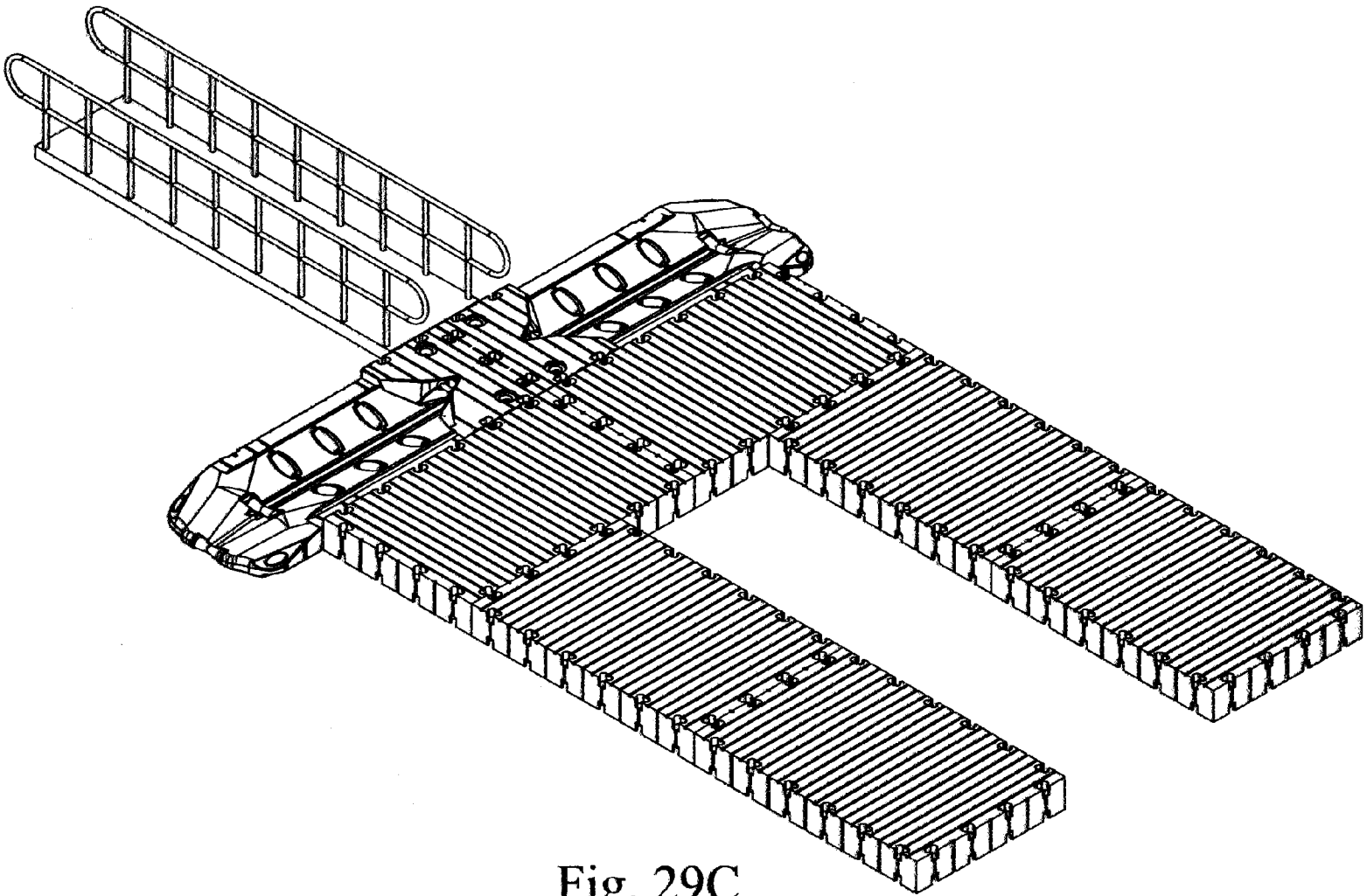
Figure 29D:
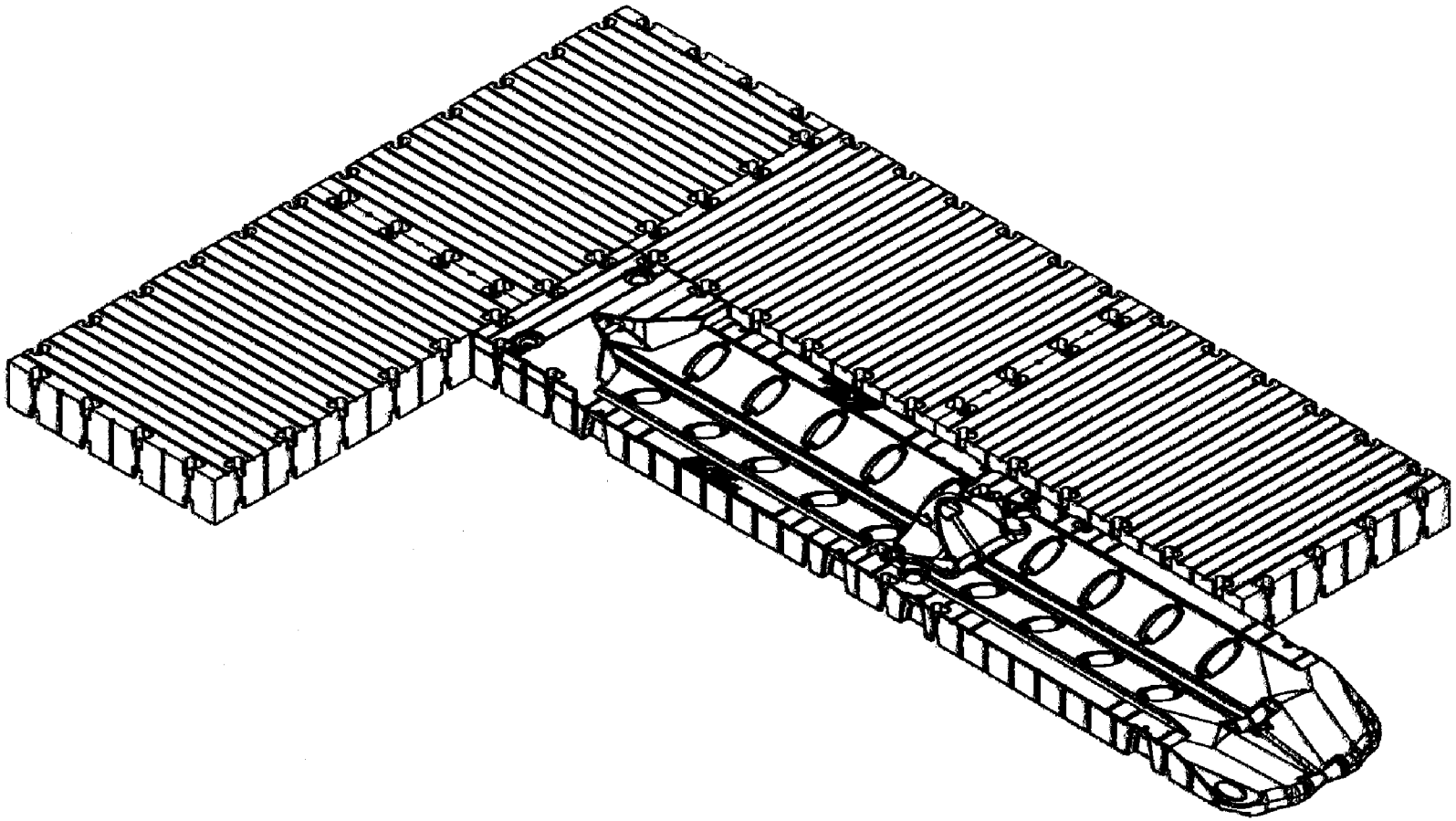

In FIGS. 29A-D, the port assemblies are shown connected to, or assembled as part of a port configuration. As seen in FIGS. 29A-D, when the port members are connected head to head and provided with the full bow stops 300, the upper surface of the bow stops 300 become part of the dock surface to allow access to the ports. In fact, as seen in FIG. 29D, a gangway to the dock assembly is connected to the full bow stops, rather than to a dock member of the assembly.

As various changes could be made in the above constructions without departing from the scope of the invention, it is intended that all matter contained in the above description or shown in the accompanying drawings shall be interpreted as illustrative and not in a limiting sense. For example, although the port system is described for use with PWC's, it could be used with other watercraft as well. The small bow stop 350 could be smaller such that the bow stop 350 does not extend the full width of the port cradle. In this instance, the bow stop 350 would cover only a portion of the rollers of the pair of rollers. Further, depending on the placement of the bow stop on the port member, and the position of the rollers on the port member, the bow stop 350 may not cover any rollers.

The invention claimed is:

1. A floating watercraft port comprising:

a port member having an upper surface, a bottom surface, side surfaces, a front surface and a back surface; a cradle being formed in at least a part of said upper surface and extending rearward from said front surface; wherein said front surface of said port member defines an opening to said cradle which is sized and shaped complementarily to the shape of said cradle and said back surface of said port member defines an entrance to said cradle; said cradle being defined by a pair of opposed inwardly sloping walls; a plurality of roller sockets positioned along said cradle walls and rollers received in said roller sockets; said upper surface defining a deck surface extending, rearwardly from said front surface on opposite sides of said cradle, said port member comprising post receiving openings extending between said bottom and upper surfaces, said openings opening onto said deck surface; and a bow stop which is separate from said port member and which is mountable to said port member at the front of said port member; wherein said bow stop extends substantially the width of said port member; said bow stop including an upper surface; a front surface, a back surface, side surfaces and a bottom surface: said upper surface defining, at least in part, a deck surface; said bottom surface being shaped substantially complementarily to said port member upper surface such that said bow stop rests on said port member upper surface and closes said opening to said cradle at said front wall when said bow stop is mounted to said port member; said bow further including post receiving openings extending upward from said bottom surface of said bow stop; said post receiving openings of said bow stop being positioned to be aligned with said post receiving openings of said port member.

2. The floating watercraft port of claim 1 including a cradle channel extending along a center of said cradle, said cradle channel being positioned between said sloping walls.

3. The floating watercraft port of claim 1 wherein said entrance to said cradle defined by said back surface includes an entrance section; said entrance section including a ramp which slopes rearwardly from a back end of said cradle; said ramp having a back end defining an entrance to said entrance section which is positioned to be at or below water level when said port is floated in water.

4. The floating watercraft port of claim 3 wherein said ramp is defined by a pair of ramp walls which slope inwardly toward a longitudinal center of said ramp; said ramp walls each comprising an outer section and an inner section; said inner section having a greater slope than said outer section.

5. The floating watercraft port of claim 3 including a cutout at a back end of said entrance section and a second roller socket at an upper, front, end of said entrance section; said port member including second rollers mounted in said cutout and said second roller socket; said cutout and second roller socket being positioned generally centrally between the sides of said port member.

6. The floating watercraft port of claim 5 wherein the roller mounted in said cutout is at or below water level when said port member is floated in water.

7. The floating watercraft port of claim 1 wherein said cradle extends the full length of said port member; said cradle being open at both said front end and said back end of said port member; said entrance defined by said back surface being shaped complementarily to the shape of said cradle.

8. The floating watercraft port of claim 1 wherein said port member includes a deck surface extending along opposite sides of said cradle; said bow stop bottom surface including flat surfaces having a width approximately equal to the width of said port deck surfaces and inwardly sloping surfaces corresponding to the cradle walls of said port member.

9. The floating watercraft port of claim 8 wherein said cradle includes a channel extending substantially the length of the cradle; said cradle channel extending between said bow stop sloping surfaces; said bow stop bottom surface including a rib which is shaped complementarily to said cradle channel.

10. The floating watercraft port of claim 1 wherein said bow stop back surface includes bow receiving area comprised of a pair of outwardly and downwardly sloping walls connected by a downwardly sloping generally U-shaped portion; such that said bow receiving area approximates the shape of a bow of a personal watercraft.

11. The floating watercraft port of claim 1 wherein said bow stop is removably mountable to said port member.

12. A floating watercraft port comprising an upper surface, a bottom surface, side surfaces, a front surface and a back surface; said port including at least one hole in said upper surface proximate said forward end of said port; a cradle being formed in at least a part of said upper surface; said cradle being defined by a pair of opposed inwardly sloping walls; a plurality of roller sockets positioned along said cradle walls and rollers received in said roller sockets; and a separate bow stop which is mountable to said port; said bow stop comprising a top surface, a front surface, side surfaces, a back surface and a bottom surface; said bottom surface being shaped complementarily to said port cradle upper surface; said back surface defining a watercraft bow receiving area; said bow receiving area being shaped to approximate the shape of a bow of a watercraft; said bow stop further including at least one post extending downwardly from said bottom surface; said bow stop post being sized and positioned to be received within said port upper surface hole.

13. A floating watercraft port comprising an upper surface, a bottom surface, side surfaces, a front surface and a back surface; a cradle being formed in at least a part of said upper surface; said cradle being defined by a pair of opposed inwardly sloping walls; a plurality of roller sockets positioned along said cradle walls and rollers received in said roller sockets; and a separate bow stop which is mountable to said port; said bow stop having a length, such that said bow stop covers at least a portion of the rollers of a pair of rollers; said bow stop including recesses in said bow stop lower surface; said recesses being positioned to be aligned with said rollers and sized to receive said rollers when said bow stop is placed on said port.

14. The floating watercraft port of claim 12 wherein said bow stop includes a handle on said upper surface.

15. The floating watercraft port of claim 14 wherein the flat top surface of the bow stop extends forwardly of the handle.

16. The floating watercraft port of claim 14 wherein the forward surface of the handle is flush with a forward surface of the bow stop; and the forward surfaces of the handle and bow stop, in combination, define a front end of the bow stop that is substantially vertical.

17. The floating watercraft port of claim 12 including a tether to secure said bow stop to said port.

18. A floating watercraft port system comprising:

at least one entry member; said at least one entry member comprising a front end, a back end, sides, a bottom surface, and an upper surface; said upper surface including a cradle defined by a pair of opposed inwardly sloping walls and an entrance section; said cradle being open at said front of said entry member; said entrance section extending from a rear of said cradle to the back of said entry member; said entry member further including connector sockets positioned at said sides and front of said entry member;

at least one extension member; said at least one extension member comprising a front end, a back end, sides, a bottom surface, and an upper surface; said upper surface including a cradle defined by a pair of opposed inwardly sloping walls; said cradle extending the full length of said extension member; said cradle being open at said front and back of said extension member; said extension member further including connector sockets positioned at one or more of said sides, front, and back of said extension member;

at least one bow stop, said bow stop being selectively positionable in one or more of said port members; and connecting members; said connecting members being receivable in aligned connector sockets of two port members to connect the port members together;

whereby a port assembly of a desired configuration can be formed by (a) connecting one or more port members together by;

1) connecting an entry member can in tandem with one or more extension members; or (2) connecting a first entry member head to head with a second entry member; or (3) connecting two entry members together side-to-side; or (4) any combination of (1)-(3) above; and (b) positioning one or more bow stops on the members of the port assembly.

19. The floating watercraft port system of claim 18 wherein said bow stop is a full bow stop; said bow stop extending substantially the width of said port member; said bow stop including an upper surface; a front surface, a back surface, side surfaces and a bottom surface; said bottom surface being shaped substantially complementarily to said port upper surface such that said bow stop rests on said port upper surface.

20. The floating watercraft port system of claim 19 wherein said port member includes a deck surface extending along opposite sides of said cradle; said bow stop bottom surface including flat surfaces having a width approximately equal to the width of said port member deck surfaces and inwardly sloping surfaces corresponding to the cradle walls of said port member.

21. The floating watercraft port system of claim 20 wherein said cradle includes a channel extending substantially the length of the cradle; said cradle channel extending between said sloping surfaces of said cradle; said bow stop bottom surface including a rib which is shaped complementarily to said cradle channel.

22. The floating watercraft port system of claim 19 wherein said bow stop back surface includes a bow receiving area comprised of a pair of outwardly and downwardly sloping walls connected by a downwardly sloping generally U-shaped portion; such that said bow receiving area approximates the shape of a bow of a personal watercraft.

23. The floating watercraft port system of claim 18 wherein said bow stop is removably mounted to said port.

24. The floating watercraft port system of claim 23 wherein said port member includes at least one hole in said upper surface proximate said forward end of said port member; said bow stop including a top surface, front surface, side surfaces, back surface and bottom surface; said bottom surface of said bow stop being shaped complementarily to said port member cradle upper surface; said back surface of said bow stop comprising a watercraft bow receiving area; said bow receiving area being shaped to approximate a bow of a watercraft; said bow stop further including at least one post extending downwardly from said bottom surface; said bow stop post being sized and positioned to be received within said port member upper surface hole.

25. The floating watercraft port system of claim 24 wherein said bow stop has a length, such that said bow stop covers at least one pair of rollers; said bow stop including recesses in said bow stop bottom surface; said recesses being positioned to be aligned with said rollers and sized to receive said rollers when said bow stop is placed on said port member.

26. The floating watercraft port system of claim 24 wherein said bow stop includes a handle on said upper surface of said bow stop.

27. The floating watercraft port system of claim 23 including a tether to secure said bow stop to said port member.

28. The floating watercraft port of claim 12 wherein said bow stop is removably mounted to said port member.

29. A floating watercraft port comprising:

a port member having an upper surface, a bottom surface, side surfaces, a front surface and a back surface; a cradle being formed in at least a part of said upper surface; said cradle extending rearwardly from said front surface; wherein said front surface defines an opening to said cradle which is sized and shaped complementarily to the shape of said cradle and said back surface of said port member defines an entrance to said cradle; said cradle being defined by a pair of opposed inwardly sloping walls; a plurality of roller sockets positioned along said cradle walls and rollers received in said roller sockets; and a bow stop which is separate from and mountable to said port member at the front of said port member; said bow stop comprising a top surface, a front surface, side surfaces, a back surface and a bottom surface; at least a portion of said bottom surface of said bow stop being shaped complementarily to said port cradle such that when said bow stop is mounted to said port member, said bow stop closes said opening to said cradle at the front of said port member.

30. The floating watercraft port of claim 29 wherein said port member is adapted to be connected in tandem with a second port member; said second port member having a top surface, a bottom surface, a front surface, a back surface, side surfaces and cradle in said top surface between said side surfaces; said cradle of said second port member being shaped complementarily to the shape of said port member; said front surface of said second port member defining an opening to said cradle of said second port member which is sized and shaped complementarily to shape of the cradle of the second port member; whereby, when said port member and said second port member are connected, the cradle of said port member is in alignment with and in communication with the cradle of said second port member to thereby form an elongate cradle which spans the junction between said port member and said second port member.

31. The floating watercraft port of claim 29 wherein said port member is a unitary, one-piece port member.

* * * * *